US012559688B2

(12) United States Patent
Purola

(10) Patent No.: US 12,559,688 B2
(45) Date of Patent: Feb. 24, 2026

(54) HEAT INTEGRATION IN A HYDROCARBON PROCESSING FACILITY

(71) Applicant: Coolbrook Oy, Helsinki (FI)

(72) Inventor: Veli Matti Purola, Helsinki (FI)

(73) Assignee: COOLBROOK OY, Helsinki (FI)

( * ) Notice: Subject to any disclaimer, the term of this patent is extended or adjusted under 35 U.S.C. 154(b) by 0 days.

(21) Appl. No.: 17/116,660

(22) Filed: Dec. 9, 2020

(65) Prior Publication Data

US 2021/0171836 A1 Jun. 10, 2021

Related U.S. Application Data

(60) Provisional application No. 62/945,469, filed on Dec. 9, 2019.

(51) Int. Cl.
*C10G 9/36* (2006.01)
*C10G 9/00* (2006.01)

(52) U.S. Cl.
CPC ..... *C10G 9/36* (2013.01); *C10G 9/002* (2013.01); *C10G 2300/1003* (2013.01); *C10G 2300/1014* (2013.01); *C10G 2300/1018* (2013.01); *C10G 2300/4043* (2013.01); *C10G 2300/4081* (2013.01); *C10G 2300/807* (2013.01); *C10G 2400/20* (2013.01)

(58) Field of Classification Search
CPC .... C10G 9/002; C10G 9/36; C10G 2300/807; C10G 2300/1003; C10G 2300/1014; C10G 2300/1018; C10G 2400/20
See application file for complete search history.

(56) References Cited

U.S. PATENT DOCUMENTS

| | | | | |
|---|---|---|---|---|
| 4,614,229 | A * | 9/1986 | Oldweiler | C10G 9/002 261/153 |
| 2006/0116543 | A1 | 6/2006 | Bellet et al. | |
| 2007/0007175 | A1* | 1/2007 | Strack | C10G 9/002 422/600 |
| 2008/0128326 | A1* | 6/2008 | McCoy | C10G 9/002 208/69 |
| 2011/0146991 | A1 | 6/2011 | Palamara et al. | |
| 2012/0024749 | A1 | 2/2012 | Strack et al. | |
| 2014/0243569 | A1 | 8/2014 | Seppala et al. | |
| 2019/0169510 | A1 | 6/2019 | Pavia et al. | |
| 2019/0284485 | A1* | 9/2019 | Van Willigenburg | B01D 3/38 |
| 2020/0290939 | A1* | 9/2020 | Van Willigenburg | C10G 9/36 |
| 2022/0127209 | A1* | 4/2022 | Ward | B01D 53/047 |

FOREIGN PATENT DOCUMENTS

| | | | |
|---|---|---|---|
| EP | 3249027 | A1 | 11/2017 |
| EP | 3415587 | A1 | 12/2018 |
| EP | 3725865 | A1 * | 10/2020 |
| JP | S58213087 | A | 6/1983 |
| JP | 2003504485 | A | 2/2003 |
| WO | 2017125833 | A1 | 7/2017 |
| WO | 2018020399 | A1 | 2/2018 |

OTHER PUBLICATIONS

International Search Report and Written Opinion issued in PCT/FI2020/050825 on Mar. 12, 2021 (16 pp.).
Office Action issued by Japanese Patent Office for Japanese Patent Application No. 2022-534440, mailed Nov. 8, 2022 (5 pp.).
Extended European Search Report, EP 20900233.6, dated Dec. 15, 2023 (11 pp.).
Ullmann's Encyclopedia of Industrial Chemistry, Ethylene, Print ISBN: 9783527303854 | Online ISBN: 9783527306732 | DOI: 10.1002/14356007, pp. 469-470, published Mar. 11, 2023 (2 pp.).
Office Action, IN 202227038647, dated Feb. 13, 2025 (6 pp.).

* cited by examiner

*Primary Examiner* — Randy Boyer
(74) *Attorney, Agent, or Firm* — Eversheds Sutherland (US) LLP

(57) ABSTRACT

A process is provided for improving energy efficiency and reducing greenhouse gas emissions in a hydrocarbon processing and/or production facility, through rearrangement of thermal energy distribution within said facility, said facility comprising a cracker unit with at least one apparatus for cracking a hydrocarbon containing feed, in presence of a dilution medium, wherein a cracked gaseous effluent exiting the apparatus is instantly cooled in a transfer line exchanger (TLE) while generating high-pressure steam, in which process any one of the: heating and/or vaporizing the hydrocarbon containing feed and/or the dilution medium, heating and/or vaporizing boiler feed water, and superheating high pressure steam generated in the TLE unit, is conducted in a heat recovery unit (HRU) arranged downstream the TLE, and which process comprises supplying electrical power into the hydrocarbon processing and/or production facility.

27 Claims, 7 Drawing Sheets

HEAT INTEGRATION IN A HYDROCARBON PROCESSING FACILITY

FIELD OF THE INVENTION

The present invention relates to systems and methods for heat integration in hydrocarbon processing. In particular, the invention relates to tools and processes for optimizing energy efficiency and reducing greenhouse gas emissions in a hydrocarbon production facility through rearranging heat distribution pathways within said facility and/or through exploitation of renewable energy.

BACKGROUND

Heat integration is crucial for improving energy efficiency and reducing operational costs in many energy related applications. Energy efficiency can be defined as a ratio between an input of energy consumption or related emissions and an output of the energy-mediated services. Improving energy efficiency in energy-intensive petroleum refining allows for reducing the use of non-renewable resources, such as fossil fuel, and associated environmental impacts.

Low-molecular olefins, such as ethylene, propylene, butenes and butadiene, are primary building blocks for petrochemical industry and serve as a basic building blocks in commercial production of plastics, polymers, elastomers, rubbers, foams, solvents, and chemical intermediates, as well as of fibers, including carbon fibers, and coatings. Production of lower olefins is largely based on thermal cracking of various hydrocarbon feedstocks with steam. The process is commonly referred to as steam cracking. Typical feedstocks include medium weight hydrocarbons, like naphthas and gasoils, and light feedstocks, like liquefied petroleum gas (LPG) including propane and butanes and natural gas liquids (NGL) including ethane, propane and butanes.

Cracking furnaces consume the most of energy in ethylene plants; therefore, their thermal efficiency is a major factor in operating economics. Overall fuel efficiencies of 92-95% net heating value (NHV) can be obtained, depending on feedstock, fuel sulfur content, firing control, and convection section type (Ullmann's Encyclopedia of Industrial Chemistry, June 2012 Ethylene, pp. 465-529).

A conventional steam cracking furnace consists of two main sections: a convection section and a radiant section. Heat carried by flue gases leaving the radiant firebox section is recovered at the convection section of the furnace. Thus, said flue gas enters the convection section at a temperature within a range of 1000-1250° C. and exits at a temperature typically within a range of 120-140° C. The lower is the flue gas stack temperature (at the exit), the better is the furnace efficiency.

Typically, the convection section consists of a series of tube banks serving a number of duties, such as: preheating feed hydrocarbons (HC preheat); preheating boiler feed water (BFW); preheating hydrocarbon- and dilution steam; superheating high pressure steam; superheating dilution steam; and superheating a hydrocarbon containing feed mixture (hydrocarbon containing feed and dilution steam) prior said mixture enters the radiant section. The number and arrangement of banks in the convection section is typically such, as to optimize waste heat recovery from flue gases and to provide an adequate feed mixture temperature to the radiant section. The banks are usually arrange in stacks, which accounts for a relatively large size of the cracking furnace.

Hydrocarbon containing feedstock provided in gaseous phase or as a liquid thus enters the convection section, in where it is typically (pre)heated and vaporized by virtue of heat exchange against a flue gas or through being contacted with dilution steam superheated in a separate bank. The furnace is normally designed so that mixing the (preheated) hydrocarbon containing feed with superheated dilution steam completely vaporizes the feed, whereafter a process stream containing hydrocarbon feed in gaseous phase and the dilution steam enters a first hydrocarbon and dilution steam preheat bank. In a second hydrocarbon and dilution steam preheat bank the process stream is heated to a temperature just below the incipient cracking temperature of the feedstock.

Heating the hydrocarbon containing feed from the temperature it enters the convection section (about 50 to 110° C. for liquid feeds) to the temperature required at the radiant coils' input (within 500-700° C. depending on feedstock) is energy-demanding. Energy input needed to achieve this temperature for the gaseous feeds is an amount of energy required for heating the gaseous phase, whereas the same for liquid feeds equals the heating energy and the heat of vaporization.

The stream then enters the radiant section, most typically, radiant coils, said radiant section being configured as a pyrolysis reactor in where cracking reactions take place under controlled conditions. Stream parameters at the inlet of the radiant section must satisfy predetermined conditions, such as temperature, pressure and flow rate. Conventional cracking conditions, where highly endothermic reactions take place, include residence time about 0.1-0.5 sec; temperature within about 750-900° C.); and controlled partial pressure. The temperature within a radiant section firebox (a structure which surrounds the radiant coils and comprises the burners) is typically between 1000-1250° C.

Cracked effluent that includes target products, such as target olefins, leaves the pyrolysis furnace for further quenching and downstream fractionation.

The products leaving the radiant coils require rapid cooling to prevent the undesirable secondary reactions from taking place. In most commercial steam cracker units/furnaces, quenching is performed in transfer line exchangers (TLEs), which cool the cracked effluent against the boiler feed water and recover heat in the form of valuable high pressure steam. Commercial solutions comprise one or two exchangers (TLEs) connected in series. TLE is designed to cool cracked effluent gases instantaneously to about 550-650° C. to prevent degradation of highly reactive products. To improve heat recovery, the effluent is cooled further; therefore, it leaves the TLE at a temperature of about 300-450° C. In ethane and propane cracking, the cracked gas can be further cooled in a separate heat exchanger down to about 200° C. to recover heat at a lower temperature. For liquid feedstocks like naphtha, for example, a typical minimum exit temperature for the TLE is approximately 360° C., to avoid condensation of heavier products and fouling the exchanger tubes. Both TLE exchangers are typically connected to the same steam drum.

Boiler feed water is preheated in a BFW economizer bank prior to entering a steam drum, from where BFW is routed into the TLEs. In conventional steam cracker furnaces, vertical TLE unit(s) is/are mounted on the top of the radiant section of the furnace. TLEs of such kind allow for recovery of about 29% of heat upon generating high pressure steam.

High pressure steam generated in the TLE unit(s) is further superheated in the high pressure steam superheating bank(s) in the convection section to produce high pressure superheated steam, which is used in steam turbine(s), such as condensation- and/or back-pressure steam turbines, for example, in compressor- or pump drive(s) or for heating purposes within the olefin production plant. Excess high pressure steam may also be exported.

Steam pressure levels can be further optimized such, as to allow utilization of steam for heating purposes. Whereas high pressure steam is typically used to drive compressors and pumps, medium- and low pressure steam (above- and below approximately 2 MPa) can be used for dilution steam generation and for the process heating, accordingly.

However, conventional furnace solutions adapted particularly for steam cracking encounter a number of drawbacks.

At first, olefin production via the steam cracking process in cracker furnaces is a mature technology that has been an industry standard for over the last 50 years. The furnaces are very large-sized, complex plants that involve significant investment costs. Additionally, optimization of said conventional cracker furnaces mainly aims at determining optimal conditions for pyrolysis reactions in the radiant section (the reaction section) of the furnace. Further economical optimization of conventional crackers leads to an increase in the size of the cracker furnace. At present, no efficient means exist to reduce emissions by decreasing the size of the furnace.

It is the radiant section that accounts for determining the performance of the cracker furnace (yields and coking rate). Optimizing operating conditions and coil design in pyrolysis reactors has been a subject of extensive investigation during last few decades.

Moreover, optimization of conventional cracking furnaces has been hindered due to a number of conflicting optimization targets, including inter alia radiant section heating, temperature at the inlet to the radiant section, equipment/utilities for high pressure steam superheating, energy efficiency, and emissions reduction.

Heat input into the radiant section (provided as combustion heat of fuel, for example) defines an amount of heat to be recovered in the convection section. To attain high thermal (energy) efficiency, a rather complicated cracker furnace is required, that includes a plurality of heating banks. Hence, reduction of carbon dioxide emissions is highly hindered or even impossible in conventional cracker furnaces. Provision of multiple tube banks accounts for a relatively large size of the cracking furnace (in terms of height and plot area and high investments, as a consequence).

Further, because the reaction heat input is determined by cracking conditions, the heat carried by flue gases has to be recovered in the convection section. However, only a limited number of heat sinks is available to recover heat released in the radiant section in conventional cracking furnaces. In order to attain high thermal efficiency, energy is saved in the convection section by preheating boiler feed water, superheating dilution steam, superheating high pressure steam and/or by preheating combustion air. Other heat sinks are formed by heat losses (wall loss and stack heat loss).

Due to fouling of the TLE unit(s), cracked gas exit temperature tends to increase, whereby less heat is recovered from the cracked gas for steam production. After the TLE(s), said cracked gas typically enters a direct quench, such as an oil quench system. Quench oil is typically used for liquid feedstocks, whereas for light feedstocks (gases, such as ethane) direct oil quench is not used. Heat is recovered in the form of quench oil and quench water.

One of the major challenges associated with the conventional olefin production technologies is generation of significant amounts of carbon dioxide ($CO_2$) and other greenhouse gases relevant for air pollution, such as nitrogen oxides ($NO_x$) and, in some instances, carbon monoxide (CO). Thus, in steam crackers, an amount of $CO_2$ produced per ton of ethylene depends on raw material used for cracking, with typical values for ethane constituting 1.0-1.2 ton $CO_2$ per ton of ethylene and for naphtha—1.8-2.0 ton $CO_2$ per ton of ethylene, accordingly. Due to complexity of existing cracker furnaces, minimization of emissions by conventional techniques is challenging.

Instead, commercial solutions aim at generating high pressure steam (HPS) for use in a separation section and/or for export. In a conventional ethylene plant, the need in high pressure steam as a heating medium is limited. Therefore, high pressure steam is typically used in steam turbines compressors and pump drives.

If there is no possibilities for high pressure steam export, the amount of steam is balanced by using condensing type steam turbines. However, in addition for being large, complex and expensive, condensing type steam turbines have low efficiency, because of heat discharge loss originating from the fact that all exhaust steam flow is condensed in the condenser that is cooled by cooling water, which means that a lot of discharged heat is lost in condensing.

Indeed, such use of valuable superheated HPS (HPSS) and HPS for heating is not energy-efficient. Typically, the ethylene cracker does not need high temperature heating sources in a separation section.

The conventional technology is bound to the use of certain amounts of boiler water due to steam production. Hence, significant amount of chemicals is required for purification of a condensate used as boiler water. Because the conventional technology is already highly integrated in terms of heat recovery, there is no means to significantly reduce the use of cooling water. In case of cooling towers significant amount of water is lost to atmosphere.

In this regard, an update in the field of hydrocarbon processing, in particular, hydrocarbon cracking technology is still desired, in view of addressing challenges associated with reduction of greenhouse gas emissions and improving heat integration within a related facility.

SUMMARY OF THE INVENTION

An objective of the present invention is to solve or to at least mitigate each of the problems arising from the limitations and disadvantages of the related art. The objective is achieved by various embodiments of a process for improving energy efficiency and reducing greenhouse gas emissions in a hydrocarbon processing and/or production facility, according to what is defined in the independent claim 1.

In embodiment, a process is provided for improving energy efficiency and reducing greenhouse gas emissions in a hydrocarbon processing and/or production facility, through rearrangement of thermal energy distribution within said facility, said facility comprising a cracker unit with at least one apparatus for cracking hydrocarbon containing feedstocks, in presence of a dilution medium, wherein a cracked gaseous effluent exiting the apparatus is cooled in a transfer line exchanger (TLE) while generating high-pressure steam, in which process, any one of the: heating and/or vaporizing the hydrocarbon containing feed and/or the dilution medium, heating and/or vaporizing boiler feed water, and superheating high pressure steam generated in the TLE unit, is conducted in a heat recovery unit (HRU) arranged downstream the TLE unit, and which process comprises supplying electrical power into the hydrocarbon processing and/or production facility.

In embodiment, the process comprises supplying electrical power to a drive engine of the cracking apparatus.

In embodiment, the process comprises supplying electrical power to the cracking apparatus (to electrically heat said cracking apparatus, for example). In embodiments, electrical power is supplied into said cracking apparatus by any one of the inductive or resistive transfer methods, plasma processes, heating by electrically conductive heating elements, or a combination thereof.

In embodiment, the process further comprises supplying electrical power to the devices or groups of devices downstream the cracker unit.

In embodiment, electrical power is supplied into a device or a group of devices adapted for any one of heating, pumping, compression and fractionation, or a combination thereof.

In embodiment, the process comprises supplying electrical power from an external, as related to the hydrocarbon processing and/or production facility, source or sources. In embodiment, said external source is a source of renewable energy or a combination of different sources of renewable energy. In embodiments, the process comprises supplying electrical power from any one of: a photovoltaic electricity generating system, a wind-powered electricity generating system, and a hydroelectric power system, or a combination thereof. In embodiment, electrical power is supplied from a nuclear power plant. In embodiment, electrical power is supplied from a power turbine, such as at least one gas turbine and/or a steam turbine, a spark ignition engine, such as at least one gas engine, a compression engine, such as at least one diesel engine, a power plant configured to produce electrical energy from fossile raw materials, and any combination thereof. In embodiment, electrical power is supplied from a combined cycle power facility and/or a cogeneration facility that produces steam and electricity.

In embodiment, electrical power is generated in the hydrocarbon processing and/or production facility.

In embodiment, the heat recovery unit is a heat exchanger, optionally configured as a secondary transfer line exchanger.

In embodiment, the apparatus for cracking the hydrocarbon containing feed is a reactor adapted for thermal and/or thermochemical hydrocarbon degradation reactions, such as pyrolysis reactions, optionally assisted by the dilution medium, such as steam.

In embodiment, the hydrocarbon processing and/or production facility is an olefin plant. In embodiment, said hydrocarbon processing and/or production facility is an ethylene plant and/or a propylene plant.

In embodiment, any one of the: heating and/or vaporizing the hydrocarbon containing feed and/or the dilution medium, heating and/or vaporizing boiler feed water, and superheating high pressure steam generated in the TLE unit, or a combination thereof, is at least partly conducted in a preheater furnace.

In embodiment, heat duty of the preheater furnace is redistributed within the cracker unit of said hydrocarbon processing and/or production facility, through the rearrangement of heat distribution within said cracker unit, such that provision of said preheater furnace in the cracker unit is omitted.

In embodiment, the process comprises generation of thermal energy, in a separate combustion chamber, by direct heating implemented by burning hydrogen with oxygen in said combustion chamber and admixing a steam product resulted from hydrogen burning and optionally admixed with the dilution medium, such as dilution steam, with a hydrocarbon feed containing process fluid. In embodiment, the temperature of hydrogen burning is regulated by routing the dilution medium, such as dilution steam, into said combustion chamber.

In embodiment, the process is arranged such that electrical power supplied from external or internal source(s) compensates, fully or partly, for steam production within the hydrocarbon processing and/or production facility.

In embodiment, thermal energy distribution and transfer in the hydrocarbon processing and/or production facility is implemented between a number of cracker units with the same or different layout and/or capacity.

In embodiments, the process comprises conducting shaft power to the cracking apparatus from at least one power turbine arranged in the hydrocarbon processing and/or production facility, said at least one power turbine optionally utilizing thermal energy generated in the cracker unit. Said at least one power turbine can be configured as any one of: a steam turbine, a gas turbine and a gas expander. In embodiment, said power turbine is coupled to the drive engine of the cracking apparatus via a drive shaft coupling.

In embodiment, the hydrocarbon containing feed is a fraction or fractions of crude oil production, distillation and/or refining. In embodiment, the hydrocarbon containing feed is a gasified preprocessed biomass material. In embodiment, the hydrocarbon containing feed is a preprocessed glyceride-containing material, such as vegetable oils and/or animal fats. In embodiment, the hydrocarbon containing feed is a gasified preprocessed plastic waste. In embodiment, the hydrocarbon containing feed comprises by-products of wood pulp industry, such as tall oil or any derivatives thereof.

In another aspect, a hydrocarbon processing and/or production facility is provided.

In still another aspect, a cracker unit comprised in the hydrocarbon processing and/or production facility is provided.

The utility of the present invention arises from a variety of reasons depending on each particular embodiment thereof. Overall, the invention allows for rearranging heat integration pathways within a hydrocarbon processing and/or production facility, such as an olefin plant, for example, by cleverly redistributing a flow of thermal energy between a number of interacting utilities including but not limited to those related to heating feed hydrocarbons, dilution steam and boiler feed water, and related heat recovery. Rearrangement of thermal energy distribution within said facility is resource—(e.g. combustion fuel) and emission efficient and allows for utilizing also available low temperature sources, such as medium- and low pressure steam, quench oil, quench water, and the like.

Additionally, the present solution enables improved optimization of the temperature difference(s) in the heat exchangers.

In the process disclosed hereby, less high pressure steam is produced in the cracker unit as compared to a conventional one. Reduced steam production can be at least partly compensated by provision of a high efficiency external steam boiler or co-generation of steam and electricity in gas turbines, gas engines or a combined power plant. Accordingly, while superheated HPS production is lower than in the conventional cracker, electric power can replace condensing HPSS steam turbines in the separation section. Such an arrangement allows for further improving energy efficiency of the olefin plant and reducing the need in cooling water and boiler feed water.

Due to advanced heat recovery and integration offered by the present invention, an amount of harmful greenhouse gas emissions, in particular, carbon dioxide and nitrogen oxide ($CO_2/NO_X$), can be reduced at least threefold, as compared to the conventional steam cracker unit. Thus, the invention provides for importing electrical power from a variety of sources, including renewable sources. Whether all electrical power in supplied into the process as from renewable sources, emissions can be almost completely eliminated.

The invention further provides for flexibly using the (renewable) electricity. Production of renewable energy varies on daily basis and even on hourly basis. The invention allows for balancing electrical power grid by employing high efficiency combined cycle gas turbines or gas engines, for example.

Implementation flexibility of the process allows for adjusting the level of capacity of the olefin plant to meet a variation of demands at optimal costs. The invention further enables a reduction in the on-site investments costs.

The terms "pyrolysis" and "cracking" are utilized in this disclosure largely as synonyms regarding the process of thermal or thermochemical degradation of heavier hydrocarbon containing precursor compounds to lighter hydrocarbon containing compounds by breaking of carbon-carbon bonds in the precursor compounds.

The expression "a number of" refers hereby to any positive integer starting from one (1), e.g. to one, two, or three. The expression "a plurality of" refers hereby to any positive integer starting from two (2), e.g. to two, three, or four. The terms "first" and "second", are used hereby to merely distinguish an element from another element without indicating any particular order or importance, unless explicitly stated otherwise.

The terms "fluid" and "process fluid" refer, in the present disclosure, largely to a hydrocarbon feed containing gaseous matter, such as e.g. a process stream gaseous phase, either in presence or absence of a diluent.

The term "gasified" is utilized hereby to indicate matter being converted into a gaseous form by any possible means.

Different embodiments of the present invention will become apparent by consideration of the detailed description and accompanying drawings.

DETAILED DESCRIPTION OF THE EMBODIMENTS

Figure 1A:
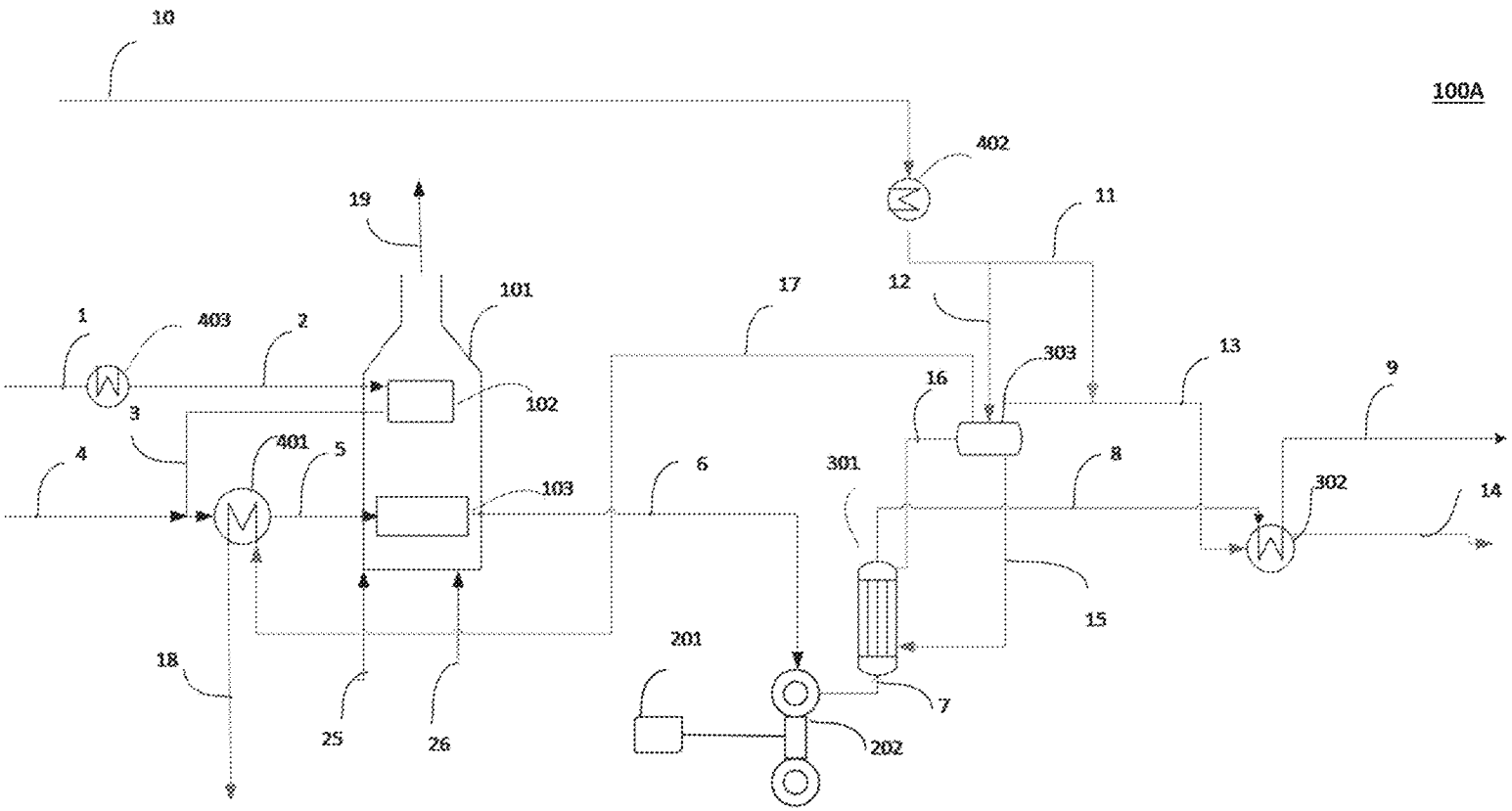
FIGS. 1A, 1B, 2-5 are schematic representations of embodiments of a process, according to the present invention.

Detailed embodiments of the present invention are disclosed herein with the reference to accompanying drawings. The following citations are used for the members:

1—hydrocarbon feed (HC);
2—preheated hydrocarbon feed;
3—vaporized feed or heated gaseous feed (exiting a heating bank 102);
4—dilution steam (DS);
5—(super)heated feed mixture (HC+DS);
6—feed mixture/process fluid that enters a cracking reactor 202 (FIGS. 1-3):
7—cracked gaseous effluent;
8—cooled cracked gaseous effluent exiting TLE 301;
9—cracked gaseous effluent exiting a heat recovery unit 302:
10, 11, 12—boiler feed water (BFW);
13—saturated high pressure steam (HPS): from a steam drum 303;
14—superheated HPS generated in the heat recovery unit 302:
15—water to TLE 301;
16—water/steam mixture from TLE 301;
17—(part) of saturated steam generated in steam drum 303:
18—a condensate:
19—flue gas(es) exiting a furnace 101:
21—a process fluid;
22—DS routed to a combustion chamber 501:
23—an oxygen stream;
24—HPS routed from 302 to the furnace 101;
25—combustion air,
26—fuel gas to heat the furnace 101;
27—saturated HPS;
28—a hydrogen stream;
29—a steam product resulted from hydrogen burning, optionally mixed with dilution steam (FIG. 5);
30—superheated steam to a power turbine;
31—steam/condensate from the power turbine;
100, 100A, 100B, 100C, 100D, 100E—a cracker unit;
101—a furnace;
102, 103, 104, 105—heating banks;
201—a drive device for an apparatus/reactor (202);
202—an apparatus for processing hydrocarbon containing feedstock(s), such as a cracking reactor;
203—a power turbine with a turbine drive device
301—a transfer line exchanger (TLE);
302—a heat recovery unit (HRU);
303—a steam drum;
401, 402, 403, 404—(additional) heat exchangers;
500—a hydrocarbon processing and/or production facility;
501—a combustion chamber.

FIG. 1A, 1B, 2-5 are schematic representations of various embodiments of a process for improving energy efficiency and reducing greenhouse gas emissions in a hydrocarbon processing and/or production facility, according to the present invention. We note that FIGS. 1A, 1B, 2-5 and Examples 1-4 serve illustrative purposes and are not intended to limit applicability of the inventive concept to the layouts expressly presented in this disclosure.

The hydrocarbon processing and/or production facility 500 (see FIG. 6), hereafter, "a facility", is an olefin production facility (an olefin plant). The facility is primarily configured for production of low-molecular olefins, such as any one of ethylene, propylene, butenes, butadienes, and the like, or any combination thereof.

The facility 500 can be configured as an ethylene plant and/or a propylene plant.

Additionally or alternatively, the facility 500 can be configured for producing higher hydrocarbons are, such as pentenes and aromatics (benzene, toluene, xylenes). The facility can be further configured for production of diolefins.

The facility 500 generally comprises a cracker unit 100 followed by a separation section. The term "separation section" is used hereby as a collective title for a plurality of devices or groups of devices provided downstream the cracker unit and aiming at recovering the desired products downstream said cracker unit. The equipment provided in the separation section is assigned with a variety of functions including, but not limited to: removal of heat contained in the cracked gas, condensation of water and heavy hydrocarbons, compression, washing, drying, separation, and hydrogenation of certain unsaturated components. The cracker unit 100 may be referred to as a "hot section" of the hydrocarbon processing and/or production facility 500, whereas the separation section may be referred to as a "cold section", accordingly.

In some configurations, the facility 500 comprises more than one cracker unit 100, e.g. including but not limited to any number from two (2) to fifty (50). In some exemplary instances, the facility can comprise 10, 20, 30 or 40 cracker units. Still, the facility 500 can be configured to include any appropriate number of the cracker units 100, even in an excess of fifty (50).

The cracker unit 100 comprises a plurality of devices and/or groups of devices with heat distribution and transfer therebetween implemented in accordance with different embodiments of the present invention. By virtue of integration and rearrangement of thermal energy distribution between said devices and/or groups of devices within the cracker unit and/or within the entire facility 500, enhanced heat integration and improved energy efficiency are put into practice. Said integration and rearrangement of thermal energy distribution within the cracker unit 100 according to the embodiments is illustrated by exemplary layouts 100A, 100A', 100B, 100C, 100D, 100E of the cracker unit 100 described further below with reference to FIGS. 1A, 1B, and FIGS. 2-5.

The cracker unit 100 comprises a (pre)heater furnace 101, hereafter referred to as "a furnace" and at least one apparatus 202 configured for thermal and/or thermochemical processing, such as cracking, of hydrocarbon containing feedstock(s). The furnace 101 and the apparatus 202 generally correspond, at least in terms of functionality, to the convection section and the radiant section, accordingly, of a conventional cracker unit, such as a conventional steam cracker unit described in the background section. In some configurations, provision of the furnace 101 can be omitted.

Hydrocarbon containing feed that enters the furnace 101 is provided in essentially fluidic form, such as liquid or gas.

The apparatus 202 is preferably configured as a reactor adapted for thermal and/or thermochemical hydrocarbon processing reactions, in particular, the thermal and/or thermochemical hydrocarbon degradation reactions, such as pyrolysis reactions, collectively resulting in cracking of hydrocarbon containing feedstock(s) and optionally assisted by the dilution medium (diluent). The reactor 202 can thus be adapted for pyrolysis reactions with or without the dilution medium. Still, presence of the dilution medium is preferable as it improves product yields.

Dilution medium exploited in the present facility is (water) steam. In steam cracking processes, steam acts as a diluent to lower the hydrocarbon partial pressure in order to suppress or to reduce the formation of coke deposits by gasification reaction(s). In some instances, the diluent is inert gaseous medium, such as hydrogen ($H_2$), nitrogen ($N_2$) or argon, for example, that possesses essentially zero reactivity towards the reactants and the reaction products. Utilization of any other suitable diluent is not excluded.

In some configurations, the apparatus 202 is a steam cracking reactor.

Pyrolysis processes, including (steam) cracking processes, require high temperature and are highly endothermic, therefore, the reactions are carried out at high temperatures (750-1000° C., typically 820-920° C.) with residence time in the reaction zone being in scale of fractions of seconds, such as about 0.01-1.0 seconds. It should be noted that depending on the feed utilized, the reactor parameters, such as temperature, mass flow rate etc., are typically adjustable in view of optimizing yields, whereby the residence times may vary accordingly. Therefore, the residence time and temperature depend on feed properties to achieve maximum yields.

Implementation of the reactor 202 generally follows the disclosures of a rotary reactor according to the U.S. Pat. No. 9,494,038 (Bushuev) and U.S. Pat. No. 9,234,140 (Seppulu et al) also referred to as a rotodynamic reactor (RDR), and of a radial reactor according to the U.S. Pat. No. 10,744,480 (Rosic & Xu) based on provisional application No. 62/743,707, the entire contents of which are incorporated by reference herewith.

The rotary reactor 202 comprises a rotor shaft with at least one rotor unit mounted onto the shaft. The rotor unit comprises a plurality of rotor (working) blades arranged over the circumference of a rotor disk together forming a rotor blade cascade. The rotor with the blade cascade is advantageously positioned between stationary (stator) vane cascades provided as essentially annular assemblies at both sides of the bladed rotor disk.

Additionally or alternatively the reactor 202 can be adapted for efficient utilization of other technologies, including but not limited to inductive or resistive energy and/or heat transfer methods, plasma processes, heating by electrically conductive heating elements and/or heating surfaces, or a combination thereof for the purpose of hydrocarbon cracking.

Additionally or alternatively, the reactor 202 can be implemented as any conventional reactor adapted for pyrolysis of hydrocarbon containing feedstock(s), in particular, for steam cracking. Commercial tubular solutions can be utilized.

The reactor 202 utilizes a drive engine 201. Overall, the reactor 202 can utilize various drive engines, such as electric motors, or it can be directly driven by gas- or steam turbine. For the purposes of the present disclosure, any appropriate type of electric motor (i.e. a device capable of transferring energy from an electrical source to a mechanical load) can be utilized. Such appliances as power converters, controllers and the like, are not described herewith. A suitable coupling is arranged between a motor drive shaft and the rotor shaft (not shown).

In selected configurations, the reactor 202 is configured for conducting at least one chemical reaction in a process fluid. In some exemplary embodiments, the reactor is configured for thermal- or thermochemical conversion of hydrocarbon containing feedstock(s), in particular, fluidized hydrocarbon containing feedstock(s). By "hydrocarbon containing feedstock(s)" we refer hereby to fluidized organic feedstock matter that primarily comprises carbon- and hydrogen.

The hydrocarbon containing feed is typically a fraction or fractions of crude oil production, distillation and/or processing/refining. Hydrocarbon feed can be selected from a group consisting of: medium weight hydrocarbons (C4-C16: boiling range of about 35° C. to about 250° C.), such as naphtas and gasoils, and light weight hydrocarbons (C2-C5, preferably C2-C4), such as ethane, propane and butanes. Napthas may include light naphtha with a boiling range 35-90° C., heavy naphtha with a boiling range 90-180° C. and a full range naphtha with a boiling range 35-180° C. Additionally or alternatively, heavier crude oil fractions (C14-C20 and C20-C50; boiling range within about 250° C. to about 350° C. and about 350° C. to about 600° C., accordingly), such as heavy vacuum gas oils and residues (e.g. hydrocracker residues), can be utilized.

Additionally or alternatively, the reactor 202 can be configured to process oxygen-containing feedstock matter, such as oxygen-containing hydrocarbon derivatives. In some configurations, the reactor 202 can be adapted to process cellulose-based feedstocks. In some additional or alternative configurations, the reactor can be adapted to process (waste) animal fats- and/or (waste) vegetable oil-based feedstocks. Preprocessing of said animal fats- and vegetable oil-based feeds may include hydrodeoxygenation (removal of oxygen from oxygen containing compounds) that results in breaking down (tri)glyceride structures and yields mostly linear alkanes. In further additional or alternative configurations, the reactor 202 can be adapted to process by-products of wood pulp industry, such as tall oil or any derivatives thereof. The definition "tall oil" refers to by-product(s) of the commonly known Kraft process used upon pulping primarily coniferous trees in wood pulp manufacture.

In the process, the hydrocarbon containing feed is provided as including, but not limited to any one of the following: medium weight hydrocarbons, such as naphthas and gasoils, and light weight hydrocarbons, such as ethane, propane, and butanes. Propanes and heavier fractions can be further utilized. Overall, the hydrocarbon containing feed that enters the facility 500 and, in particular, the cracker unit 100, is either a gaseous feed or an essentially liquid feed.

In some instances, the hydrocarbon containing feed is a gasified peprocessed biomass material. Biomass-based feed is cellulose-derived or, in particular, lignocellulose-derived preprocessed biomass, supplied into the reactor in substantially gaseous form.

The hydrocarbon containing feed can be further provided as any one of the preprocessed glyceride-based material, such as (waste or residual) vegetable oils and/or animal fats, or preprocessed plastic waste or residue. Preprocessing of said (tri)glyceride-based feedstocks may include different processes, such as pyrolysis or deoxygenation, as described above. A range of plastic waste comprising PVC, PE, PP, PS materials and mixtures thereof can be utilized in the processes of recovery of pyrolysis oil or gas that can be further used as a feedstock for producing new plastics and/or refined to fuel oil(s) (diesel equivalents).

In a number of configurations, the reactor 202 can be adapted for refining preprocessed gasified biomass feeds to produce renewable fuels in processes such as direct catalytic hydrogenation of plant oil into corresponding alkanes or catalytic dehydrogenation of gaseous hydrocarbons as one of the stages of Fischer-Tropsch process, for example.

In an event of utilization of feedstocks based on biomass-, glyceride- and/or polymeric substances, the reactor 202 may be further adapted for catalytic processes. This is achieved by a number of catalytic surfaces formed by catalytic coating(s) of reactor blades or internal walls being in contact with process fluid(s). In some instances, the reactor may comprise a number of catalytic modules defined by ceramic or metallic substrate(s) or support carrier(s) with an active (catalytic) coating optionally realized as monolithic honeycomb structures.

The cracker unit 100 may comprise a number of reactors units 202 arranged in parallel, for example, and connected to a common furnace 101. In some configurations, the facility may comprise a number of reactor units 202 connected to several furnaces 101. Different configurations may be conceived, such as n+x reactors connected to n furnaces, wherein n is equal to or more than zero (0) and x is equal to or more than one (1). Thus, in some configurations, the facility 500 and, in particular, the cracker unit 100, may comprise one, two, three or four parallel reactor units connected to the common furnace 101; the number of reactors exceeding four (4) is not excluded. When connecting, in parallel, a number of rotary type reactors 202 to the common furnace 101, one or more of said reactors 202 may have different type of drive engine, e.g. the electric motor driven reactor(s) can be combined with those driven by steam turbine, gas turbine and/or gas engine.

Figure 1B:
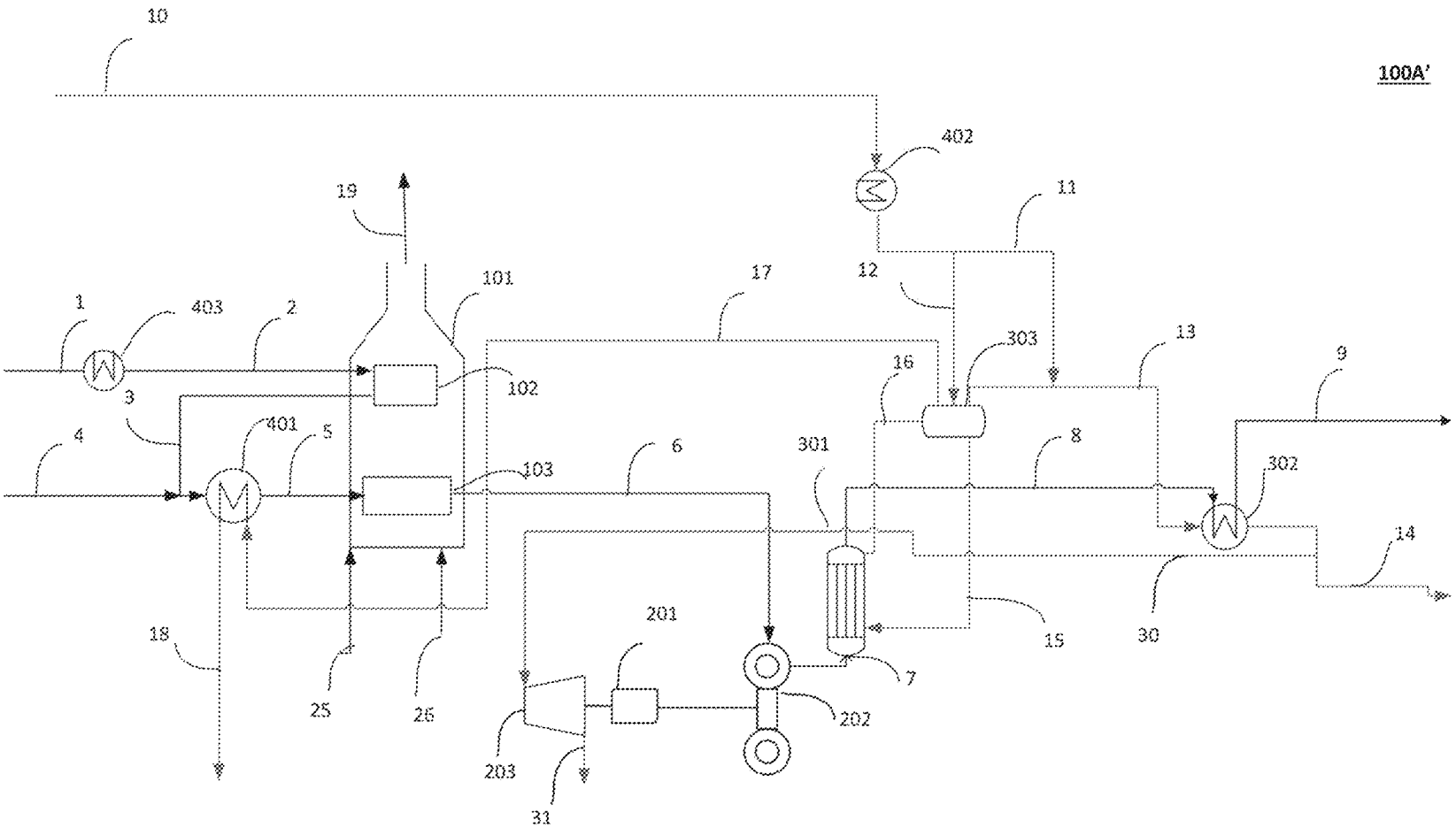

Conducting electrical power into a drive engine of the reactor 202 can be further accompanied with conducting mechanical shaft power thereto from a power turbine, for example, optionally utilizing thermal energy generated elsewhere in the cracker unit 100 and/or the facility 500 (see FIG. 1B and related description). By way of example, steam generated in a quenching apparatus (e.g. transfer line exchanger 301 and/or heat recovery unit 302 with appropriate configuration) can be further used on a steam turbine that is mechanically connected, via an appropriate coupling, to a shaft of the rotary reactor 202. The turbine will return mechanical energy to the reactor shaft, which will result in reduction of electric power consumption needed for driving the reactor.

Whether the facility 500 comprises more than one cracker unit 100, each of said units can have essentially similar design than the others or it can be configured independently (aka with essentially same or different utility layout, equipment capacity, and the like). Thus, in some configurations, thermal energy distribution and transfer in the facility 500 can be implemented between a number of cracker units 100 with same or different layout and/or capacity.

The facility 500 can be configured to include a number of different cracker units 100 including but not limited to any combination of layouts 100A-100E presented herewith (FIGS. 1-5) and/or conventional cracker(s), such as steam cracker(s). In fact, heat integration solutions described further below are generally applicable in conventional crackers optionally arranged in conventional olefin plants for the purposes of optimizing energy balance in high pressure steam production, for example.

Figure 6:
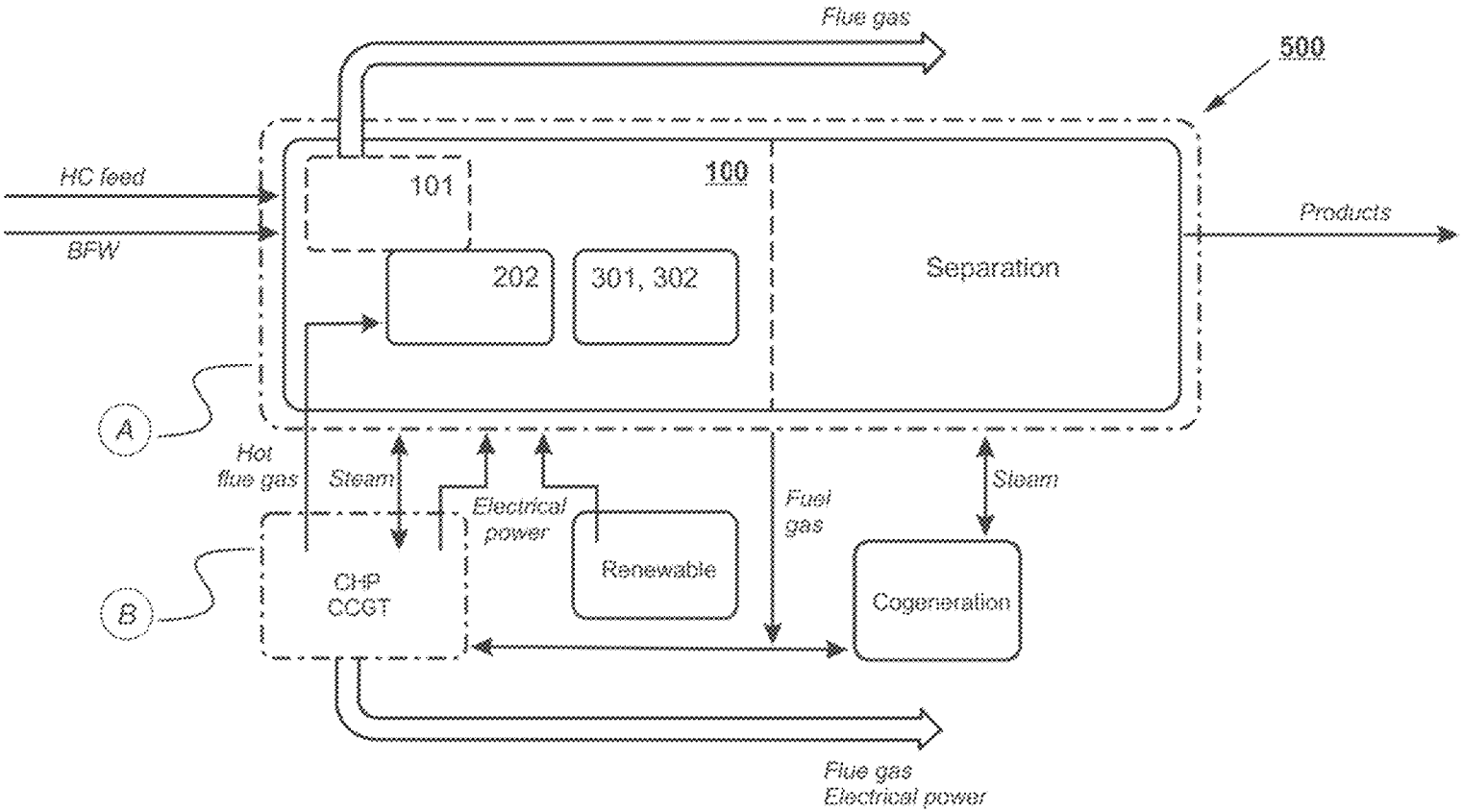
FIG. 6 is a schematic representation of thermal energy flow integration and redistribution within the hydrocarbon processing and/or production facility, according to an embodiment.

The furnace 101 can be heated by fuel (e.g. fuel gas) and air. Additionally or alternatively the furnace can be heated by hot exhaust gases routed into the cracker unit 100 from at least one turbine, such as a gas turbine, for example (FIG. 6). Additionally or alternatively, said exhaust gases can originate from the gas turbine or gas engine used as a drive for one or more of the reactors units 202 in the facility, in manner described above. Additionally or alternatively, the furnace 101 can be heated with any essentially biobased materials, such as biogas or wood based solid materials, for example.

The facility further comprises, in the cracker unit 100, at least one transfer line exchanger (TLE) 301, in where a cracked gaseous effluent exiting the reactor 202 at a temperature within a range of 750-1000° C., typically 820-920° C.) is cooled while generating high-pressure steam (HPS 6-12.5 MPa, 280-327° C.).

The temperature of the cracked gaseous effluent at the TLE exit is provided within a range of about 450° C. to about 650° C. The TLE 301 can be configured as any conventional transfer line exchanger unit capable to conduct instant cooling of the cracked products. Cooling thus occurs in a very short time interval, typically, within few milliseconds to provide the highest yield.

The process further involves exploitation of at least one heat recovery unit (HRU) 302 arranged downstream the TLE 301, within the cracker unit 100.

In the process disclosed hereby, the heat recovery unit 302 provided downstream the TLE 301 is configured to perform at least one of the following operations: heating and/or vaporizing the hydrocarbon containing feed and/or the dilution medium, heating and/or vaporizing boiler feed water, and superheating high pressure steam generated in the TLE unit.

As mentioned hereinabove, in conventional (steam) crackers, the cracked gaseous effluent exiting the pyrolysis reactor may, in some instances, be cooled in the TLE units connected in series. While the primary TIE (TLE1) is configured for instantaneous quenching to stop degradation reactions (exit temperature within 450-650° C.), the secondary TLE (TLE2) further cools the process fluid down to approximately 360° C. to avoid condensation of the cracked products. TLE1 and TLE2 are typically connected to the same steam drum.

Temperatures of the cracked gases 9 exiting the heat recovery unit 302 are defined accordingly to conventional crackers, i.e. the temperature shall be high enough to avoid condensation of heavy fractions and fouling of the heat exchanger. Thus, for naphtha-type feedstocks, the temperature should be approximately 360° C. whereas for lighter feedstocks lower temperatures can generally be applied (e.g. 300-450° C.). In ethane- and propane cracking, cracked gas can be cooled down even to about 200° C.

In the process disclosed herewith, heat integration within the cracker unit 100 of the hydrocarbon processing and/or production facility is modified such that less thermal energy (heat) is recovered in the transfer line exchanger(s).

On the contrary to conventional solutions, in the process disclosed, at least one heat recovery unit 302 disposed downstream the TLE 301 is assigned with a number of functions other than production of high pressure steam. Heat integration is modified in such a way that the amount of heat generally recoverable in transfer line exchanger(s) is then lower compared to that obtained in conventional facilities. Heat recovered in the heat recovery unit 302 is used for the superheating of HPS (produced in the TLE 301) and/or for generally heating and preheating purposes, such as to heat the hydrocarbon containing feed, a dilution steam mixture or any other stream within the hydrocarbon processing and/or production facility.

To achieve superheating temperatures, high pressure steam (6-12.5 MPa) is generally (super)heated as follows: HPS 6 MPa, 450-470° C.; HPS 10 MPa, 510-540° C., typically, 530° C.; and HPS 12 MPa, 530-550° C.

In some configurations, the heat recovery unit 302 generally operates at a lower pressure than a conventional secondary TLE, when the latter is used for steam generation or heating. In some other configurations, in where steam for superheating in the HRU 302 is produced in the TLE 301, the heat recovery unit 302 operates approximately at the same pressure as the conventional secondary TLE unit.

The heat recovery unit 302 can be implemented as a heat transfer unit, such as a heat exchanger. Design of the heat recovery unit configured as the heat exchanger depends on a particular function assigned to said heat recovery unit, aka preheating/heating/vaporizing operations (feed stream, diluent stream and/or other stream, such as BFW stream) or superheating high pressure steam produced in the TLE 301.

Some embodiments include provision of the heat recovery unit 302 configured as the transfer line exchanger (TLE2) arranged downstream the transfer line exchanger 301 (the latter acting as a primary TLE (TLE1) in this context), wherein high pressure steam produced in said primary TLE 301 is superheated in said secondary TLE 302 (see also description to FIG. 1A). By such an arrangement, the amount of high pressure steam transferred from the cracker unit 100 to the separation section is reduced; and steam production within the cracker unit 100/the facility 500 is compensated, partly or fully (viz. supplemented or replaced) with electrical power supplied from external or internal source(s). In similar manner, steam consumption can be reduced, accordingly. Electrical power is defined as a rate of energy transfer per unit time (measured in Watt).

Heat duty of the entire pyrolysis process is the energy required to heat the feedstock and dilution steam from the temperature at which they enter the furnace convection section to the temperature at which they leave the pyrolysis reactor, including the heat duty needed for chemical reactions. Heat duty typically assigned to the convection section of a conventional furnace is heating feedstock and dilution steam to the temperature they enter the pyrolysis reactor, heating boiler feed water before it is used for high pressure steam production in the TLE unit(s) and superheating the saturated high pressure steam produced in the TLEs.

In the process disclosed hereby, the heat recovery unit 302 is generally not used for the production of high pressure steam (although in terms of hardware design and functionality, the unit 302 may be fully capable of generating HPS). Therefore, less steam is available for superheating in the preheater furnace 101 and for generating power in the downstream equipment (e.g. in cracking gas compressor turbines), accordingly.

Still, the high pressure steam, that has been generated in the process, can be used in a heat exchanger 401, for example (FIGS. 1A, 1B, 2-5), to superheat a mixture of hydrocarbon feed and dilution steam prior said feed mixture enters the furnace 101. Such an arrangement enables efficient use of saturated superheated steam and further reduces the need for superheating HPS intended for export (to other consumers, such as any type of petrochemical facility/oil refinery).

In the process, while production of the superheated high pressure steam (HPSS) is lower than in conventional cracker solutions, reduced steam production can be at least partly compensated by conducting electrical power into the hydrocarbon processing and/or production facility 500. Reduced steam production can be further compensated to fill heating needs by a supporting facility or facilities, such as a high efficiency external steam boiler or by co-generation of steam and electricity in gas turbines, gas engines or in a combined heat and power plant.

Apparently, current technologies have limited possibilities for heat integration into a cracking furnace and/or the TLE(s). Integration of renewable electricity into conventional solutions is difficult due to production of superheated HPS for use in steam turbines for electricity generation and/or in drive engines. To get steam into balance, condensing turbines are typically used. These condensing turbines have a very low efficiency and consume a lot of cooling water. Integration with sustainable energy production modules, including but not limited to the renewable energy production facilities and/or the high efficient electricity production facilities, such as combined cycle gas turbine power plants, for example, is therefore hindered due to own high pressure steam production.

On the contrary, the process disclosed hereby comprises supplying electric power into the hydrocarbon processing and/or production facility 500. In some configurations, electrical power is supplied into the devices or groups of devices generally located in the cracker unit 100.

In the process, electrical power can be supplied into a drive engine of the cracking apparatus 202. In some configurations, the electric motor driven apparatus 202 can be implemented as a rotary reactor according to the U.S. patent disclosure U.S. Pat. No. 9,234,140 (Seppala et al), for example.

Electrical power can be supplied into the cracking apparatus 202. This can be done through supplying electric current to the electric motor used to propel a rotary shaft of the apparatus 202 or by alternative methods, such as via direct heating, for example. Exemplary configurations for the process, in which electrical power is supplied into the reactor 202 to implement direct heating include, but are not limited to any one of the inductive or resistive energy transfer methods, plasma processes, heating by electrically conductive heating elements and/or heating surfaces, or a combination thereof for the purposes of cracking.

Additionally or alternatively, electrical power is supplied into the devices or groups of devices generally located downstream of said cracker unit, aka into the separation/fractionation section. Thus, electrical power can be supplied into a device or a group of devices adapted for any one of heating-, compression-pumping and fractionation, or a combination thereof.

In the process, electrical power can be generally supplied into the equipment provided in the cracker unit 100 (comprising the (preheating) furnace 101, reactor unit(s) 202 and associated downstream appliances 301, 302 and optionally associated utilities 401-404) and/or into the equipment provided downstream of said cracker unit, viz. into the separation section (see FIG. 6).

Supply of electrical power into the process can be implemented from an external source or sources (as related to the hydrocarbon processing and/or production facility 500). Additionally or alternatively, electrical power can be produced internally, within said facility 500.

An external source or sources include a variety of supporting facilities rendered for sustainable energy production. Thus, electrical power can be supplied from an electricity generating system that exploits at least one source of renewable energy or a combination of the electricity generating systems exploiting different sources of renewable energy. External sources of renewable energy can be provided as solar, wind- and/or hydropower. Thus, electrical power may be received into the process from at least one of the following units: a photovoltaic electricity generating system, a wind-powered electricity generating system, and a hydroelectric power system. In some exemplary instances, a nuclear power plant may be provided as the external source of electrical power. Nuclear power plants are generally regarded as emission-free. The term "nuclear power plant" should be interpreted as using traditional nuclear power and, additionally or alternatively, fusion power.

Electricity can be supplied from a power plant that utilizes a turbine as a kinetic energy source to drive electricity generators. In some instances, electrical power can be supplied into the facility 500 from at least one gas turbine (GT) provided as a separate installation or within a cogeneration facility and/or a combined cycle power facility, for example. Electrical power can thus be supplied from at least one of the following units: a combined cycle power facility, such as a combined cycle gas turbine plant (CCGT), and/or a cogeneration facility configured for electricity production combined with heat recovery and utilization through combined heat and power (CHP), for example. In some examples, the CHP plant can be a biomass fired plant to increase the share of renewable energy in the process described. Additionally or alternatively, supply of electrical power can be realized from a spark ignition engine, such as a gas engine, for example, and/or a compression engine, such as a diesel engine, for example, optionally provided as a part of an engine power plant. Still further, any conventional power plant configured to produce electrical energy from fossile raw materials, such as coal, oil, natural gas, gasoline, and the like, typically mediated with the use of steam turbines, can be integrated with the facility 500.

Any combination of the abovementioned sources of electrical power, realized as external and internal sources, may be conceived.

The process can further utilize hydrogen as a source of renewable energy, to be reconverted into electricity, for example, using fuel cells, or to be burned in the preheating furnace 101.

In the process, electrical power supplied from external or internal source(s) described hereinabove, compensates, partly or fully, for the thermal energy generated in steam production within the hydrocarbon processing and/or production facility 500. Thus, use of electrical power can at least partly replace the thermal energy of steam produced in condensing- and/or back-pressure steam turbines in the separation section.

Here again, in a conventional cracker unit, some of the main compressors are driven by condensing turbine(s) or back pressure turbines and a number of pumps (e.g. QO, QW, part of BFW/CW pumps) are driven by back pressure turbine(s). To fulfill its heating duties, the process utilizes low pressure steam (LP steam; 0.45 MPa), for example, except dilution steam generation, which typically requires medium pressure steam (MP steam; 1.6 MPa). In said conventional cracker unit, equipped with a back-pressure steam turbine drive, for example, steam extraction is adjusted such, that both medium- and low pressure steam levels are in balance (with the difference between the imported and exported energy being essentially zero). Excess steam is preferably exported at a high pressure steam level (6.0-12.5 MPa).

If there is no possibility for high pressure steam export, the amount of steam is balanced by using the condensing type steam turbines. However, as already mentioned herein above, in addition for being large, complex and expensive, condensing type steam turbines have low efficiency, because most of the heat energy is lost in condensing.

The cracker unit 100 is configured to generate high pressure steam in an amount lower than that generated in the conventional cracker. Therefore, in the facility 500, in particular in the separation section thereof, condensing turbines can be at least partly replaced by more efficient turbine solutions, such as back-pressure steam turbines, for example. Back-pressure steam turbines increase energy efficiency by balancing steam needs via energy (heat) extraction at required steam pressure levels. In some instances, provision of condensing turbine(s) in the separation section can be entirely omitted. In all cases, steam turbines in the separation section can be at least partly replaced by electric motors, for example. Any other energy-efficient solution can be utilized to replace, at least partly, the conventional condensing-type turbines in the facility 500.

Overall, thermal efficiency of a conventional condensing steam turbine is less than 40%. To compare, thermal efficiency of a high efficiency gas turbine is up to 40%, thermal efficiency of a combined cycle gas turbine is up to 60%, while the same of a cogeneration plant (steam and electricity) exceeds 80%.

Importing low emission electric power from an alternative (external) source further improves energy efficiency of the hydrocarbon processing and/or production facility.

The invention is flexible in terms of receiving electrical power from different sources. Electrical power balance can be adjusted on a case-by-case basis by adjusting the amount of renewable electricity (the amount of electrical power supplied from renewable source or sources) and an amount of electrical power obtained from a combined cycle gas turbine facility (CCGT), for example. An electrical grid (an electricity supply network) can be created over the facility 500 that would connect said facility with a number of electricity generating systems.

Said electrical grid can be flexibly integrated into other power grids, such as a steam production—and supply network and a heat production- and supply network. Via functional integration of any one of the electricity-, heat- and/or steam production networks into the facility 500, considerable improvements related to energy efficiency can be achieved.

Rearranging heat integration in a manner described hereby allows for constructing a hydrocarbon processing and/or production facility, such as an ethylene plant, for example, having a preheater furnace significantly reduced in size or, alternatively, in an absence of said preheater furnace. If projected to conventional solutions, this means that the steam cracker unit can be realized in an absence of a cracker furnace in its traditional realization.

FIG. 6 is a schematic representation of thermal energy flow integration and redistribution within the hydrocarbon processing and/or production facility 500. Battery limit without electricity production is indicated by a circled capital A: whereas the battery limit with electricity production is indicated by a circled capital B (with A included). In case B, the facility 500 is functionally integrated with an exemplary combined cycle gas turbine facility (CCGT), which can be viewed as a certain modification of a combined heat and power facility (CHP). The CCGT unit is the external electrical power generation facility (with regard to 500) The combined cycle gas turbine operates with thermal efficiency of up to 60%; therefore, importing low emission electrical power produced by said CCGT into the hydrocarbon processing and/or production facility 500 further improves energy efficiency of said facility. Hot flue gas exiting the CCGT unit can be routed into the cracker unit 100 for (pre)heating fluids in the preheater furnace 101 and/or in the cracking apparatus 202.

In addition- or as an alternative to thermal energy generated by CCGT, low emission electrical power can be supplied into the facility 500 from the renewable sources indicated on FIG. 6 with a "Renewable" box, and/or from a cogeneration facility indicated as a "Cogeneration" box. Additionally or alternatively, the solution enables further integration of steam- and/or fuel gas production-, delivery- and/or consumer system(s) to any kind of processing and/or production facility (e.g. other than an olefin production plant) with improved overall energy efficiency (not shown).

Advanced heat recovery and integration allow for reducing greenhouse gas emissions, in particular, carbon dioxide and nitrogen oxide gases ($CO_2/NO_X$), at least threefold, as compared to the conventional steam cracker unit. Comparative energy- and material balance simulations (see Examples 1-4) have been performed for naphtha steam cracking in a conventional naphtha steam cracker plant and the facility 500 (see FIG. 6). These examples illustrate flexibility of the process disclosed herewith and demonstrate significant reduction in net energy consumption, as well as reduction in $CO_2$ emissions, cooling water and boiler (feed) water consumption.

By (re)arranging heat distribution utilities according to configurations shown on FIGS. 1A, 1B, 2 and 3, significant reduction in the furnace 101 size can be achieved in comparison to conventional solutions. This is attained by assigning the heating duties, normally performed in the convection section banks, to the individual heat recovery unit(s) and/or associated utilities, such as auxiliary heat exchangers.

Figure 4:
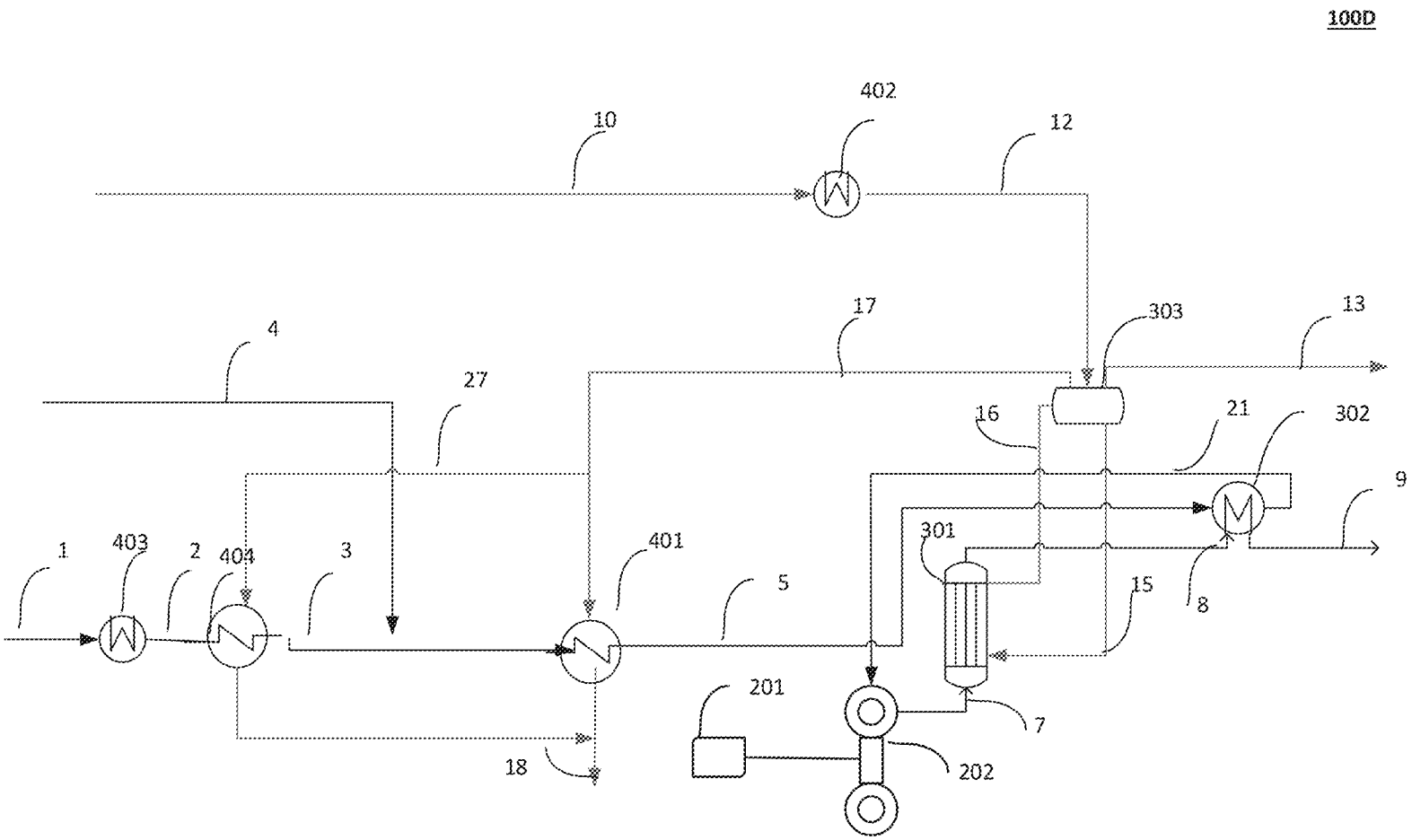
Figure 5:
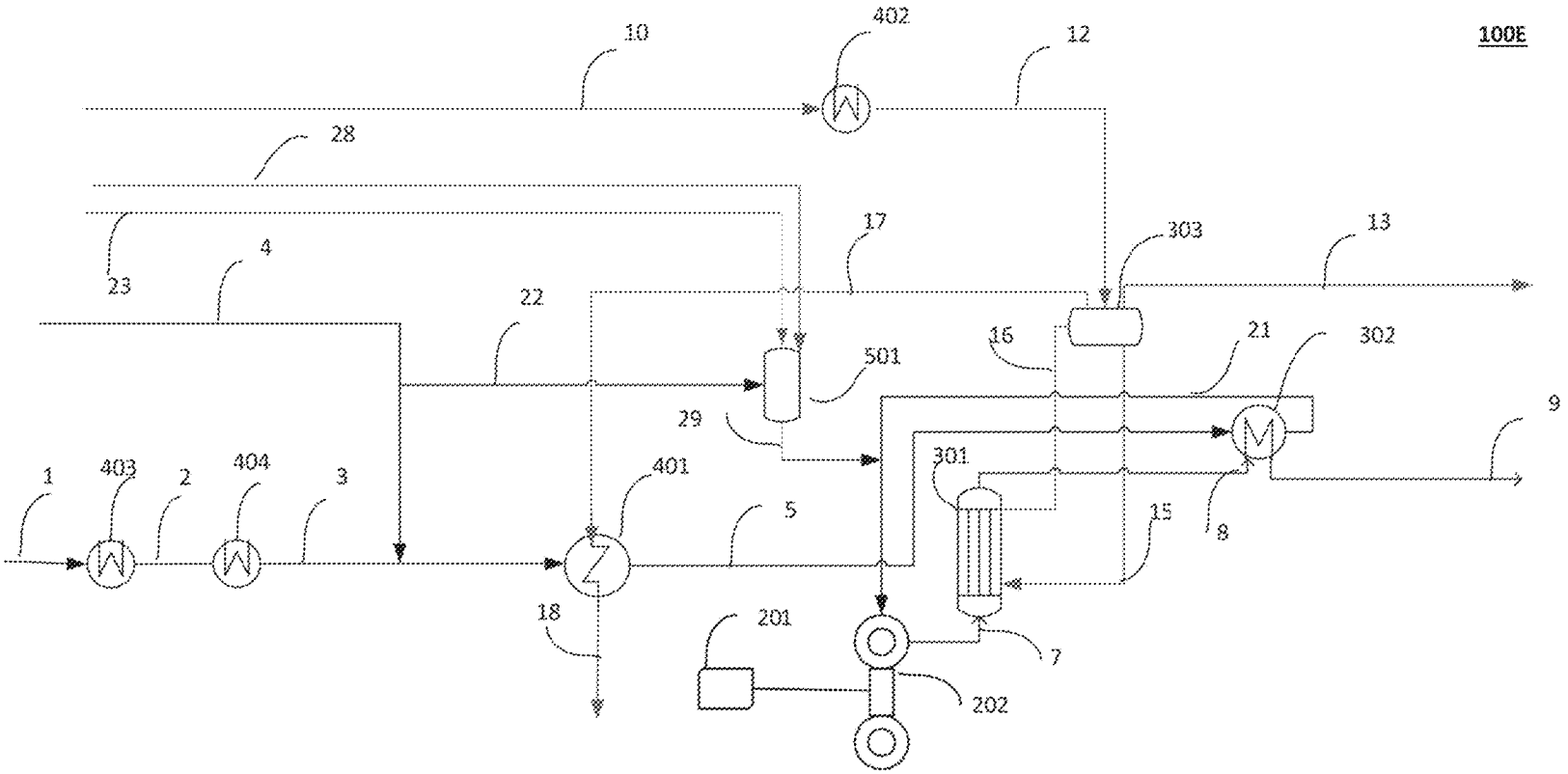

FIGS. 4 and 5, in turn, show the process embodied without the furnace 101.

FIG. 1A schematically illustrates an embodiment of the process conducted in the cracker unit embodied as 100A, in where the heat recovery unit 302 is used as the HPS superheater. Cracked gaseous effluent exiting the cracking apparatus 202 undergoes initial cooling in the TLE 301, to stop pyrolysis reactions and to produce high pressure steam, thereafter heat from initially cooled cracked gaseous effluent is routed into the heat exchanger unit 302 to superheat HPS generated in 301 to generate high pressure steam superheated (HPSS 6-12.5 MPa) to a predetermined (superheating) temperature, as described hereinabove).

In the process of FIG. 1A, hydrocarbon containing feed 1, typically liquid feed, is heated in a heat exchanger 403 to a furnace inlet temperature within a range of 50 to 110° C., preferably, 60 to 90° C. (for liquid feeds). Preheating low temperature streams enables reducing flue gas stack temperature (flue gas exit temperature), which, in turn, accounts for improved thermal efficiency in the furnace 101. Streams used for (pre)heating are quench water, quench oil or low pressure steam, for example.

Preheated hydrocarbon containing feed 2 enters the furnace 101, in where feed is vaporized in a heating bank 102. Vaporized feed 3 is mixed with dilution steam (DS) 4, which is generated in a dedicated dilution steam generation unit (not shown) downstream the heat recovery unit 302. Resulted process fluid provided as a mixture of hydrocarbon feed (HC and dilution steam (DS) is heated in a heat exchanger 401 by using, as a heating medium, saturated high pressure steam 17 from a steam drum 303. Thus produced (and heated) feed mixture 5 (HC+DS) is further heated to a reactor inlet temperature in the HC+DS bank 103 to the temperature slightly below the incipient cracking temperature of the feed (500-700° C., preferably, 620-680° C.). Process fluid 6 is routed to the cracking reactor 202.

Stream 26 is fuel gas used to heat the furnace 101, whereas stream 25 is combustion air. Additionally or alternatively, heating the furnace 101 can be implemented by using exhaust gases from gas turbine(s) located inside or outside the battery limit of the cracking facility (see options A and B on FIG. 6). In such an event, additional burners can be installed in the furnace 101 to give sufficient heat input.

Pyrolysis reactions take place in the apparatus 202. In configuration, the reactor 202 has an electric motor or it can be driven directly by a gas turbine, for example. Residence time in the reactor is minimized to avoid degradation of valuable products. Cracked gaseous effluent 7 is routed, via a corresponding interconnecting line, to the TLE 301. Reactor exit temperature may vary in accordance with selected operating conditions, type of the feedstock, etc. The temperature at the TLE inlet is within a range of about 750-1000° C., preferably, 820-920° C.

TLE 301 rapidly cools cracked gaseous effluent 7 to about 450-650° C. TLE generates high pressure steam 16 (HPS, 6-12.5 MPa). Cooled cracked gas 8 exiting the TLE 301 is routed into the heat recovery unit 302.

Boiler feed water 10 is preheated to a predetermined temperature, preferably, to the value sufficiently close or above of the HPS boiling point (e.g. 110-200° C.) in a heat exchanger 402. Low temperature medium, such as medium pressure steam or quench oil, for example, is used as a heating medium. Part of the saturated steam 17 is used for (super)heating process fluid/a feed mixture in the heat exchanger 401.

Saturated HPS 13 is superheated in the heat recovery unit 302 to generate superheated HPS 14 (HPSS 6-12.5 MPa). Typically, the temperature of the HPSS 14 or, optionally, of a cracked gaseous effluent 9 exiting the heat recovery unit 302 can be regulated by injecting boiler feed water 11 into an attemperator device (not shown; in practice located downstream of 11) of said heat recovery unit 302, via mixing steam and water.

Excess heat recovered from flue gases can be further used for preheating combustion air 25 or boiler feed water (not shown in FIG. 1A).

Whether several reactor units 202 are utilized in conjunction with the common furnace 101, said reactor units 202 may also have a common TLE unit 301 and/or a common heat recovery unit 302.

In some configurations, provision of the furnace 101 from the layout 100A of FIG. 1A can be omitted (now shown). In such an event, the furnace 101 and the preheating banks 102, 103 provided therein are replaced with electric heaters, for example. Simulation results for the layout 100A with the furnace 101 replaced with electric heaters are presented in Example 1 (Case B).

FIG. 1B illustrates an exemplary modification of the process according to FIG. 1A. The process is conducted in the cracker unit embodied as 100A', accordingly. The layout comprises a power turbine with a turbine drive indicated with a reference number 203. The turbine is advantageously arranged in the cracker unit 100A' (the latter being provided in the related facility 500); however, it can be appropriately placed also outside said unit (100A') and the facility (500).

In presented configuration the power turbine is a steam turbine (e.g. a back-pressure turbine or a condensing turbine). Additionally or alternatively, the power turbine can be a gas turbine or a process gas expander with appropriate configuration. The power turbine can thus be configured to utilize steam- or combustion fuel generated energy. A combination of several turbines utilizing different power sources can be utilized (e.g. steam- and fuel powered turbines). Said at least one power turbine 203 is advantageously coupled to the reactor 202 via a drive shaft coupling. Hence, the turbine 203, e.g. the steam turbine, has its motor drive coupled to the same shaft as the drive 201 of the rotary reactor 202.

FIG. 1B illustrates the layout, wherein superheated steam 30 from the heat recovery unit 302 with appropriate configuration can be further used on the steam turbine 203 with its drive mechanically connected to the shaft of the rotary reactor 202.

Superheated steam 30 from the HRU 302 is thus conducted to the power turbine 203 (configured, in present example, as a steam turbine) to provide mechanical shaft power to the (rotary) reactor 202. Shaft power is defined as mechanical power transmitted from one rotating element to another and calculated as a sum of the torque and the speed of rotation of the shaft. Mechanical power is defined, in turn, as an amount of work or energy per unit time (measured in Watt).

Mechanical shaft power can be conducted to the (shaft of the) reactor 202 from a power input machinery (hereby, the turbine 203). Supply of the shaft power can be at least partly compensated (viz. supplemented or replaced) with electrical power as an input to the electric drive engine 201. Hence, any one of the electric motor 201 and the (steam) turbine 203 can be used to drive the reactor 202. Overall, the shaft power from the steam turbine and the electric motor can be divided so that any one of those can provide the full shaft power or a fraction of it.

Conducting mechanical power (shaft power) to the reactor shaft, via the turbine 203, for example, allows for reducing consumption of electrical power needed for driving the reactor. This allows for optimization of electrical power use with regard to the other sources of power.

Apart from the HRU 302, in alternative or additional configurations, the superheated steam 30 can obtained from any other device arranged in the cracker unit 100/facility 500 or from a source external to said facility 500.

Depending on the type of the power (steam) turbine utilized in the cracker unit 100, a stream 31 can be either steam from a steam back-pressure turbine or a condensate from a condensing turbine. Back-pressure turbines may be preferred, since heat extracted from the steam 31 can be utilized for the process heating purposes in the cracker unit 100 (hot section) or in the separation section.

In some instances, the electric motor 201 is used as a helper to initially start the reactor arrangement 202, with engagement of the power turbine 203 (configured as steam- and/or gas turbine, for example) after the process is sufficiently stabilized. Hence, the reactor 202 and/or the drive engine (201) thereof is/are supplied with electrical power and, additionally or alternatively, with mechanical shaft power from the power turbine 203 optionally configured to utilize thermal energy extracted from pressurized steam 30 generated in the cracker unit 100 (e.g. in the transfer line exchanger 301, the heat recovery unit 302, and/or a combustion chamber, see below).

Figure 2:
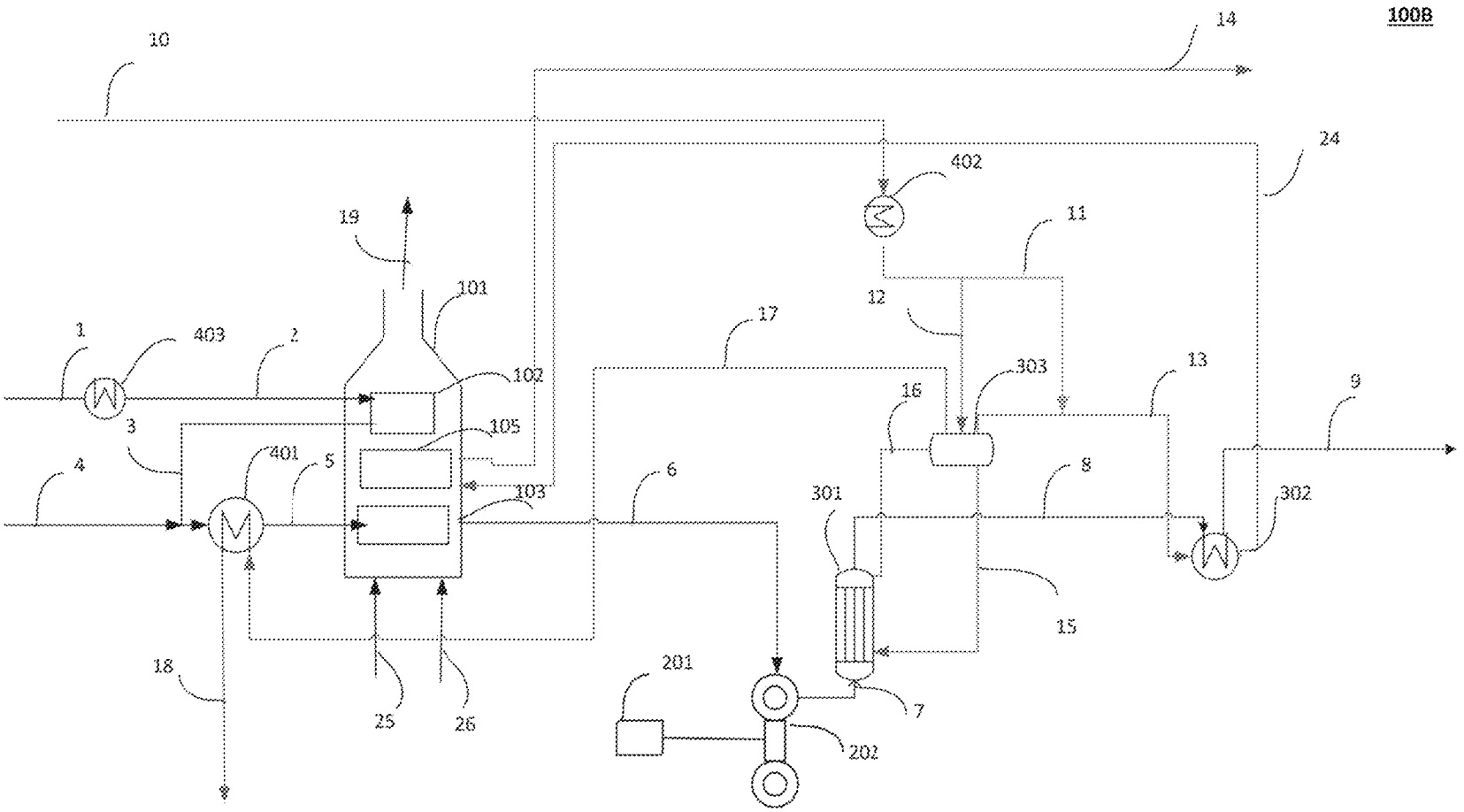

FIG. 2 illustrates another exemplary modification of the process according to FIG. 1A. The process is conducted in the cracker unit embodied as 100B, accordingly. High pressure steam 24 exiting the heat recovery unit 302 is routed into the furnace 101 (bank 105) for being superheated to a predetermined temperature. Process layout as shown on FIG. 2 is particularly applicable when the TLE unit 301 does not generate thermal energy sufficient for superheating or when the heat recovery unit 302 is not in use.

Figure 3:
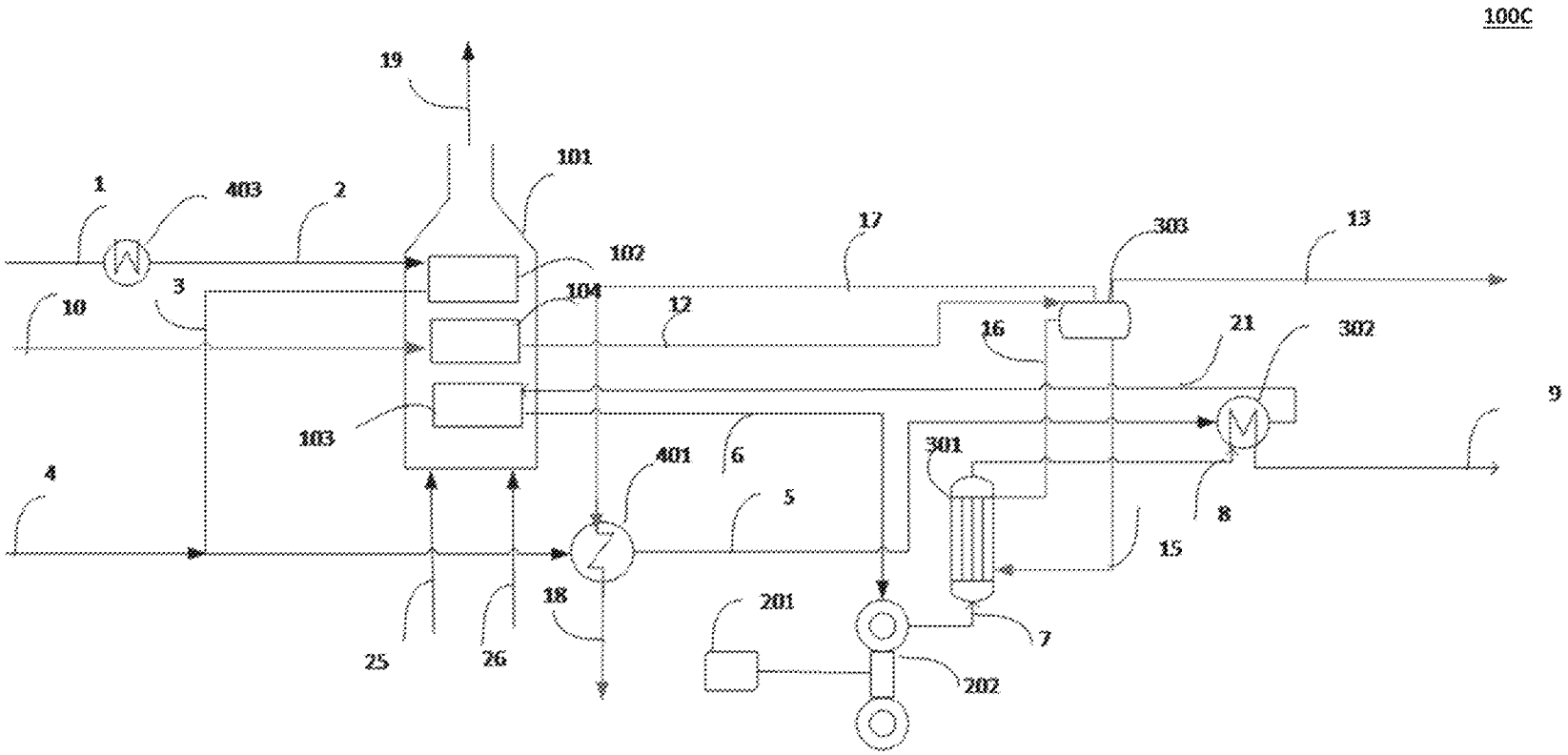

FIG. 3 schematically illustrates an embodiment of the process conducted in the cracker unit embodied as 100C, in where the heat recovery unit 302 is used as a heater for the process fluid (HC+DS) prior said process fluid enters the furnace 101. Thermal energy necessary for heating is recovered in the heat recovery unit 302 from the cracked gaseous effluent cooled in the TLE 301.

In the process of FIG. 3, hydrocarbon containing feed 1, typically liquid feed, is preheated in a heat exchanger 403 to a furnace inlet temperature within a range of 50 to 110° C., preferably, 60 to 90° C., in the same manner as disclosed for the process of FIG. 1A. Preheated hydrocarbon containing liquid feed 2 enters the furnace 101, in where feed is vaporized in the heating bank 102. Vaporized feed 3 is mixed with dilution steam (DS) 4, which is generated in the dedicated dilution steam generation unit (not shown) downstream the heat recovery unit 302. Resulted process fluid (HC+DS) is superheated in the heat exchanger 401 by using saturated high pressure steam 17 from the steam drum 303 as a heating medium.

Pyrolysis reactions take place in the apparatus 202. In configuration, the reactor 202 has an electric motor or it can be driven directly by a gas turbine, for example. Cracked gaseous effluent 7 is routed, via a corresponding interconnecting line, to the TLE 301. TLE inlet temperature is within a range of about 750-1000° C., preferably, 820-920° C. TLE 301 rapidly cools cracked gaseous effluent 7 to about 450-650° C. TLE generates HPS 16 (6-12.5 MPa). Effluent 8 exiting the TLE 301 is routed into the heat recovery unit 302.

Boiler feed water 10 is preheated to a predetermined temperature, preferably, to the value sufficiently close or above of the HPS boiling point (e.g. 110-200° C.) in a heating bank 104 (furnace 101). Boiler feed water can be heated also by quench water, quench oil or steam (not shown in FIG. 3). Part of the saturated steam 17 is used for (super)heating process fluid/feed mixture in the heat exchanger 401.

Saturated HPS 13 is exported into other utilities (e.g. in downstream fractionation section; not in the Figure). Saturated HPS can be also superheated in furnace 101 (not shown in FIG. 3).

FIG. 4 schematically illustrates an embodiment of the process conducted in the cracker unit embodied as 100D, in where provision of the preheater furnace 101 within the hydrocarbon processing and/or production facility is omitted.

In the process of FIG. 4, hydrocarbon containing feed 1, typically liquid feed, is preheated, by quench water, quench oil or low pressure steam, for example, in a heat exchanger 403 to a temperature within a range of 50 to 110° C., preferably, 60 to 90°. Preheated liquid feed 2 is vaporized in a heat exchanger 404 against saturated high pressure steam 27. Vaporized feed 3 is mixed with dilution steam (DS) 4, which is generated in the dedicated dilution steam generation unit (not shown) downstream the heat recovery unit 302. Resulted process fluid (HC+DS) is preheated in the heat exchanger 401 by using, as a heating medium, the saturated high pressure steam 17 from the steam drum 303.

Thus generated superheated process fluid 5 is heated in the heat recovery unit 302, implemented, in the configuration, as a heat exchanger, and then routed into the pyrolysis reactor 202. Temperature at the exit of the heat recovery unit 302 depends on available heat content and the temperature of the process fluid exiting the TLE 301. HRU 302 thus utilizes the TLE exit gas(es) as a heating medium. Reactor 202 inlet temperature is in the range of 400-570° C., more typically to 450-500° C. Alternatively, an electric heater or heaters (not shown) can be arranged adjacent to the entrance of the reactor 202 (not shown) to preheat the reactor feed to temperatures typical at the reactor inlet.

Pyrolysis reactions take place in the reactor 202. In some configurations, the reactor 202 preferably has an electric motor. Cracked gaseous effluent 7 is routed, via a corresponding interconnecting line, to the TLE 301. Reactor exit temperature may vary in accordance with selected operating conditions, type of the feedstock, etc. The temperature at the TLE inlet is within a range of about 750-1000° C., preferably, 820-920° C.

TLE 301 rapidly cools cracked gaseous effluent 7 to about 550-650° C. TLE generates high pressure steam 16 (HPS, 6-12.5 MPa).

Part of the saturated steam 17 is used for (super)heating process fluid/feed mixture in the heat exchanger 401. Saturated HPS 13 is exported to other utilities.

The process can further comprise generating thermal energy, in a separate combustion chamber 501 (FIG. 5), by direct heating, optionally burning, of hydrogen (hydrogen gas). Burning hydrogen with oxygen is preferably implemented. In some instances, the temperature of hydrogen burning is regulated by routing dilution steam into the combustion chamber 501. Thus, by routing dilution steam into the combustion chamber 501, hydrogen burning temperature can be reduced.

Preferably, high-purity oxygen 23 and hydrogen 28 are utilized. By using high-purity gases, presence of impurities like carbon oxides (CO, $CO_2$) and nitrogen ($N_2$) in the downstream can be avoided or at least minimized. It is preferred, that hydrogen has purity within a range of 90 to 99.9 vol-%, more preferably 99.9 vol-%. High-purity hydrogen can be obtained from a hydrogen purification unit (not shown). Oxygen concentration is provided within a range of 90 to 99-vol %, preferably, more than 95 vol-%. In order to avoid formation of carbon oxides (CO, $CO_2$) during burning, the content of hydrocarbon impurities should also be minimized.

FIG. 5 schematically illustrates an embodiment of the process conducted in the cracker unit embodied as 100E, in where heating is implemented by direct heating, optionally performed via burning hydrogen with oxygen. In present context, by direct heating we refer to a process of (direct) heat supply from a hot process stream to a cold process stream, typically realized via mixing of said process streams. FIG. 5 thus illustrates a concept of applicability of said direct heating to the layout of FIG. 4. Although not shown, said direct heating can be also applied to the configurations shown on FIGS. 1A, 1B, 2 and 3 in order to minimize (pre)heating in the furnace 101.

In the process of FIG. 5, the hydrocarbon containing feed 1, typically liquid feed, is preheated, by quench water, quench oil or low pressure steam, for example, in a heat exchanger 403 or a train of heat exchangers to maximize heat recovery from the low temperature heat sources (sometimes called waste heat). Preheated liquid feed 2 is vaporized in a heat exchanger 404 against saturated high pressure steam, for example (indicated by reference numeral 27 on FIG. 4) or any other available high temperature heat source from the facility 500 or from an external source. The stream 27 is omitted from FIG. 5, since any other suitable steam stream can be utilized instead of stream 27. Vaporized feed 3 is mixed with dilution steam (DS). Dilution steam 4 is generated in the dedicated dilution steam generation unit (not shown) downstream the heat recovery unit 302. Part of the dilution stream 22 may be routed into the combustion chamber 501, in order to regulate the temperature of hydrogen burning. Resulted process fluid (HC+DS) is preheated in the heat exchanger 401 by using, as a heating medium, the saturated high pressure steam 17 from the steam drum 303.

Thus generated superheated process fluid 5 is heated in the heat recovery unit 302 implemented, in the configuration, as a heat exchanger and then combined with hot steam from a combustion chamber 501 (a process referred to as direct heating, in the context of present disclosure). Temperature at the exit of the heat recovery unit 302 depends on available heat content and the temperature of the process fluid exiting the TLE 301. Temperature of the stream 21 (process fluid that enters the reactor 202) is in the range of 400-570° C., more typically to 450-500° C.

Hydrogen 28 is burned with oxygen 23 in the combustion chamber 501. Hydrogen and oxygen thus enter an exothermic reaction to produce water molecules. Under high temperature conditions established in the combustion chamber, water emerges as steam (gaseous phase). To decrease temperature of thus generated steam 29 (a steam product resulted from hydrogen burning), dilution steam 22 can be routed into the combustion chamber before mixing it with the hydrocarbon feed containing process fluid entering the reactor 202. Without cooling, the high temperature steam product 29 may cause coking when mixed with hydrocarbon feed containing process fluid. Dilution steam injection into the combustion chamber also decreases the temperature in said chamber, which allows utilization of less expensive materials. Mixing is preferably implemented in close proximity to the reactor inlet.

Pyrolysis reactions take place in the reactor 202. In configuration, the reactor 202 preferably has an electric motor. Residence time in the reactor and in the interconnecting pipe is minimized to avoid degradation of valuable products. Cracked gaseous effluent 7 is routed, via a corresponding interconnecting line, to the TLE 301. Reactor exit temperature may vary in accordance with selected operating conditions, type of the feedstock, etc. The temperature at the TLE inlet is within a range of about 750-1000° C., preferably, 820-920° C.

TLE 301 rapidly cools cracked gaseous effluent 7 to about 450-650° C. TLE generates high pressure steam 16 (HPS, 6-12 MPa).

Boiler feed water 10 is preheated to a predetermined temperature, preferably, to the value sufficiently close or above of the HPS boiling point (e.g. 110-200° C.) in a heat exchanger 402. Quench water, quench oil or steam can be utilized as heating media.

Part of the saturated steam 17 is used for (super)heating process fluid/feed mixture in the heat exchanger 401. Saturated HPS 13 is exported to the other consumers.

The process configurations of FIGS. 1A, 1B 2-5 are also applicable to gaseous feeds. Whether such a gas feed is utilized instead of liquid, a preheater 403 may be unnecessary. In such a case, heat duty otherwise allocated for vaporizing feed in the heating bank 102 is smaller because the gaseous feed requires no vaporizing. In an event the gaseous feedstock is utilized, the process fluid temperature at the heat recovery unit 302 exit can be significantly lower, accordingly, in comparison to related temperature values necessary when utilizing liquid feedstocks, due to a lower risk of coking and condensation of the exchanger tubes. Therefore, an amount of the superheated high pressure steam generated during the process can be optimized in accordance with consumption levels of the saturated steam.

In some embodiments implementing different configurations of the facility 500, it is advantageous to import medium pressure steam (MPS) for heating purposes. Imported medium pressure steam can be generated in combined power generating units, for example, and/or imported as an excess energy from the other supporting units or facilities to improve energy efficiency. Medium pressure steam can be also generated on purpose in steam boilers provided in the cracker unit 100/facility 500, for example.

The following Examples 1-4 illustrate comparative energy- and material balance simulations performed for naphtha steam cracking in the conventional naphtha steam cracker plant and the facility 500 (see FIG. 6). In said Examples, the facility 500 was configured as an ethylene production plant utilizing the rotary reactor 202 and therefore, it is further referred to as a rotary reactor plant. In simulations, the reactor 202 is a rotary reactor (RDR) implemented according to the guidelines set in the U.S. patent disclosure U.S. Pat. No. 9,234,140 (Seppla et al). Due to short residence times (times that hydrocarbon feedstock containing process fluid spends in the reaction space) and higher temperatures, the rotary reactor has higher yields and lower feedstock consumption.

Both conventional and RDR plants had ethylene production capacity of 1000 kt/a (kiloton per annum) with annual operating time 8400 hours). In both plants, the separation section had the same configuration and the same steam/naphtha ratio (steam/naphtha ratio=0.5). Feedstocks were similar (naphtha feed) and battery limit conditions were the same for both plants.

In simulations, steam balance was adjusted so that all produced medium pressure and low pressure steam were consumed and excess superheated high pressure steam (HPSS 10 MPa/100 bara (bar absolute); 530° C.) was exported and taken as energy credit. HPSS was consumed in back pressure turbine drives and condensing steam turbine drives. Electric power consumed in the rotary reactor plant is assumed to be $CO_2$ emission free.

Example 1. Comparison of a Conventional Plant and a Rotary Reactor Plant (500) Comprising a (Rotary) Cracker Unit 100 Implemented According to a Concept of FIG. 1A Table 1 shows the energy- and material balance simulation summary for a conventional plant (Conventional), a rotary reactor plant 500 with a fuel gas operated furnace 101 (Case A. Rotary reactor plant) and a rotary reactor plant 500, where reactor feed preheating (furnace 101) shown in the FIG. 1 has been replaced by electric heaters (Case B. Rotary reactor plant).

TABLE 1

| | Conventional | A. Rotary reactor plant (500) | B. Rotary reactor plant (500)[1] |
|---|---|---|---|
| Net energy consumption, MW | 687.6 | 542.0 | 531.0 |
| Fuel gas export, MW | 86.2 | 372.3 | 590.5 |
| Credit HP steam export (10 MPa/100 bar), MW | 100.5 | 4.1 | 4.1 |
| Material balance | | | |
| Product | t/h | t/h | t/h |
| Hydrogen, 99.9% | 2.4 | 2.1 | 2.1 |
| Fuel gas | 60.1 | 40.6 | 40.6 |
| Ethylene, polymer grade | 119.1 | 119.1 | 119.1 |
| Propylene, polymer grade | 49.4 | 40.7 | 40.7 |
| Raw C4 | 27.8 | 20.9 | 20.9 |
| Pyrolysis gasoline | 66.7 | 56.1 | 56.1 |
| Pyrolysis fueloil | 14.0 | 2.8 | 2.8 |
| Naphtha feed, t/h | 339.4 | 282.1 | 282.1 |
| CO2, kg/h | 144844 | 39778 | 0 |
| Cooling water duty, MW | 419 | 312 | 312 |
| Boiler water, t/h | 484 | 242 | 242 |

[1]Preheating furnace 101 replaced by electric heaters.

Thus, in the event the cracker unit 100 was implemented according to the layout 100A of FIG. 1A with the rotary reactor 202, net energy consumption decreased by 21% and 22% for the rotary reactor plant configurations in Cases A and B compared to the conventional cracker. For clarity, net energy consumption has been defined as total energy consumption (not shown) from where the high pressure steam export (credit) was subtracted (refer to the line "Credit HP steam export" in Table 1).

The cracker unit layout according to Case B is described hereinabove with reference to FIG. 1A (note: Case B is not on the figure).

Accordingly, generation of carbon dioxide (calculated per fuel fired for preheating; inside battery limit) in the facility 500 constituted about 27.5% and 0% (Cases A and B) of the value obtained with the conventional steam cracker (reduction by about 72.5% and 100%). Thus, with configuration B it is possible to increase an amount of renewable electricity to 100%. In such an event, dependent on the other process parameters utilized, carbon dioxide emissions are almost completely eliminated (0 kg/h). Naturally, $NO_x$ emissions decrease with $CO_2$ emissions.

The example above is also indicative of reduced cooling duty in the facility 500. Thus, cooling duty decreases by about 25%. The reduction of boiler feed water consumption is even more significant, as it decreases by 50%.

With particular regard to the Case A as compared to the conventional solution, one may observe, that by replacing radiant coils in a conventional (steam) cracking furnace by the rotary reactor 202 and, additionally or alternatively, by provision of the heat recovery unit 302, also heat duty of the furnace 101 can be reduced by about 30% as compared with that of the conventional cracking furnace convection section. In such an event, also the specific net energy consumption (fuel and electricity; GJ/t) could be reduced by about 20.5%, as calculated for ethylene production (not shown). This value reflects the reduction in the furnace size.

Example 2. Comparison of a Conventional Plant and a Rotary Reactor Plant (500) Comprising a (Rotary) Cracker Unit 100 Implemented According to a Concept of FIG. 1A, but with the Matching Yields Comparative energy- and material balance simulation has been performed for configurations as described in Example 1. The difference relative to the Example 1 is that the operating conditions for the rotary reactor 202 have been selected to essentially match its yields (hereby, ethylene yields) with the (ethylene) yields obtained in the conventional hydrocarbon (naphtha) cracker. This simulation demonstrates the situation, where it is advantageous to maintain the same product distribution when replacing the conventional cracker unit with the rotary reactor cracker unit 100 in the facility 500. The results of simulation are summarized in Table 2.

TABLE 2

| | Conventional | A. Rotary reactor plant (500) | B. Rotary reactor plant (500)[1] |
|---|---|---|---|
| Net energy consumption, MW | 687.6 | 574.2 | 560.3 |
| Fuel Gas export, MW | 86.2 | 586.1 | 862.2 |
| Credit HP steam export (10 MPa/100 bar) | 100.5 | 21.9 | 21.9 |
| Material balance | | | |
| Product | t/h | t/h | t/h |
| Hydrogen, 99.9% | 2.4 | 2.4 | 2.4 |
| Fuel gas | 60.1 | 60.1 | 60.1 |
| Ethylene, polymer grade | 119.1 | 119.1 | 119.1 |
| Propylene, polymer grade | 49.4 | 49.4 | 49.4 |
| Raw C4 | 27.8 | 27.8 | 27.8 |
| Pyrolysis gasoline | 66.7 | 66.7 | 66.7 |
| Pyrolysis fueloil | 14.0 | 14.0 | 14.0 |
| Naphtha feed t/h | 339.4 | 339.4 | 339.4 |

TABLE 2-continued

| | Conventional | A. Rotary reactor plant (500) | B. Rotary reactor plant (500)[1] |
|---|---|---|---|
| CO2, kg/h | 144844 | 51483 | 0 |
| Cooling water duty, MW | 419 | 370 | 370 |
| Boiler water, t/h | 484 | 273 | 273 |

[1]Preheating furnace replaced by electric heaters.

Also in these cases, energy consumption and $CO_2$ emissions drop significantly. Net energy consumption decreases 16.5% and 18.5% for rotary reactor plant configurations A and B, accordingly. The decrease in $CO_2$ emissions constitutes 64% and 100% respectively for the rotary plant cases A and B. Additionally, the balance demonstrates significant reduction in cooling duty (11%) and in the use of boiler feed water (43%).

Example 3. A Concept of FIG. 4 Designed for Electric Heating

In example, configuration of the rotary cracker unit 100 has been implemented according to the layout 100D of FIG. 4. In practice, the mixture of the hydrocarbon containing feedstock and diluent (e.g. naphtha-steam mixture) is preheated in the heat exchanger 401 by the saturated high pressure steam. Superheated process fluid is then heated in the heat recovery unit 302 prior to be routed into the rotary reactor 202. The HRU 302 is implemented in this configuration as a heat exchanger, where the TLE (301) exit gases are used as a heating medium.

To implement the heating in the facility 500, the medium pressure steam (1.6 MPa/16 bar) has been imported into the process in this calculation example. Additionally or alternatively, electrical power can be utilized for heating in addition to or instead of the medium pressure steam. By importing the medium pressure steam, electricity consumption can be reduced. Medium pressure steam generation is included into the net energy consumption and $CO_2$ emission calculation.

TABLE 3

| | Conventional | Rotary reactor plant (500) with an electrified cracker unit |
|---|---|---|
| Net energy consumption, MW | 687.6 | 492.6 |
| Fuel gas export MW | 86.2 | 543.1 |
| MP steam import | | 44.5 |
| Credit HP steam export (10 MPa/100 bar) | 100.5 | 0.0 |
| Total electric consumption, MW | 7.2 | 445.2 |
| Material balance | | |
| Product | t/h | t/h |
| Hydrogen, 99.9% | 2.4 | 2.1 |
| Fuel gas | 60.1 | 40.6 |
| Ethylene, polymer grade | 119.1 | 119.1 |
| Propylene, polymer grade | 49.4 | 40.7 |
| Raw C4 | 27.8 | 20.9 |
| Pyrolysis gasoline | 66.7 | 56.1 |
| Pyrolysis fueloil | 14.0 | 2.8 |
| Naphtha feed, t/h | 339.4 | 282.1 |
| CO2, kg/h | 144852 | 8635 |
| Cooling water duty, MW | 419 | 262 |
| Boiler water, t/h | 484 | 251 |

Present calculation example shows how total electric consumption can be further reduced by using different heat integration arrangement in the reactor section. In the Example 1, net energy consumption for the 100% electrified concept (rotary reactor configuration B) constitutes 531 MW, while in the present Example itis only 445.2 MW. Hence, decrease in electricity consumption compared to the layout of Example 1 is about 16%.

Example 4. A Concept of FIG. 5—Hydrogen Burning

In present example, configuration of the rotary cracker unit 100 has been implemented according to the layout 100E of FIG. 5.

In this concept, produced hydrogen is burned with oxygen in the combustion chamber 501 and diluted with (dilution) steam before mixing with feed naphtha/steam mixture (HC+DS). Table 4 shows energy- and material balance simulation results for two configurations for the rotary reactor plant (500) comprising the cracker unit 100E (FIG. 5). In Case A, all heat energy supplied into the process is converted from electrical energy (i.e. the heating is entirely electric heating). In Case B, the heating is implemented by importing medium pressure steam (1.6 MPa/16 bar) into the process. By importing medium pressure steam, electricity consumption can be reduced. In particular, the layout of FIG. 5 improves overall energy efficiency in industrial complexes having a consumer for energy which would otherwise have less value in the other plants. Hydrogen fuel energy is not included into energy consumption calculation. Medium pressure steam generation is included into the net energy consumption calculation.

TABLE 4

| | A. Produced hydrogen burned - Rotary reactor plant (500) | B. Produced hydrogen burned and MP steam imported - Rotary reactor plant (500) |
|---|---|---|
| Net energy consumption MW | 421.4 | 423.5 |
| Fuel gas export, MW | 590.5 | 556.0 |
| MP steam import, MW | | 32.4 |
| Credit HP steam export (10 MPa/100 bar) | 0.0 | 0.0 |
| Total electric consumption, MW | 421.4 | 389.0 |
| Material balance | | |
| Product | t/h | t/h |
| Hydrogen, 99.9% | 2.1 | 2.1 |
| Fuel gas | 40.6 | 40.6 |
| Ethylene, polymer grade | 119.1 | 119.1 |
| Propylene, polymer grade | 40.7 | 40.7 |
| Raw C4 | 20.9 | 20.9 |
| Pyrolysis gasoline | 56.1 | 56.1 |
| Pyrolysis fueloil | 2.8 | 2.8 |
| Naptha feed, t/h | 282.1 | 282.1 |
| CO2, kg/h | 0 | 6338 |
| Cooling water duty, MW | 262 | 262 |
| Boiler water, t/h | 251 | 251 |

Presented calculation example shows how total electric consumption can be further reduced via direct heating realized by burning hydrogen with oxygen in the combustion chamber 501 and mixing a hot steam product resulted from hydrogen burning (29, FIG. 5) with a process fluid stream that contains hydrocarbon feed. Dilution medium, such as dissolution steam can be admixed into the steam product 29 prior to mixing the latter with the hydrocarbon feed containing process fluid. In Example 1, net energy consumption for a 100% electrified concept (rotary reactor configuration B) constituted 531 MW, as compared to 421 MW and 389 MW in the hydrogen burning concept. In an event of importing the medium pressure steam into the process (Case B, Table 4), decrease in electricity consumption is about 26%.

In further aspects, a cracker unit 100 (100A-100E) and a hydrocarbon processing and/or production facility 500 are independently provided, configured to implement the process according to the embodiments described hereinabove.

It is clear to a person skilled in the art that with the advancement of technology the basic ideas of the present invention may be implemented and combined in various ways. The invention and its embodiments are thus not limited to the examples described herein above, instead they may generally vary within the scope of the appended claims.

The invention claimed is:

1. A process for improving energy efficiency and reducing greenhouse gas emissions in a hydrocarbon processing and/or production facility, through rearrangement of thermal energy distribution within said facility, said facility comprising a cracker unit with at least one cracking apparatus for cracking a hydrocarbon containing feed, in presence of a dilution medium, wherein a cracked gaseous effluent exiting the cracking apparatus is cooled in a transfer line exchanger (TLE) unit while generating high-pressure steam having a pressure of between 6 MPa and 12.5 MPa, wherein the process comprises supplying electrical power into the at least one cracking apparatus of said cracker unit with the hydrocarbon process and/or producing facility, wherein, in said process, a heat recovery unit (HRU) arranged downstream from the TLE unit is assigned with functions other than production of high pressure steam, including receiving the cooled cracked gaseous effluent and high-pressure steam from the TLE unit and superheating the high-pressure steam generated in the TLE unit, wherein less high-pressure steam is produced in the cracker unit as compared to a conventional cracker unit, and wherein electrical power supplied into the at least one cracking apparatus of said cracker unit within the hydrocarbon processing and/or production facility compensates for reduced steam production in said cracker unit, and wherein the HRU is positioned outside of a convection section of the cracker unit.

2. The process of claim 1, wherein electrical power is supplied to a drive engine of the at least one cracking apparatus.

3. The process of claim 1, wherein electrical power is supplied by any one of the inductive or resistive transfer methods, plasma processes, heating by electrically conductive heating elements, or a combination thereof.

4. The process of claim 1, wherein electrical power is additionally supplied to devices or groups of devices arranged downstream the cracker unit.

5. The process of claim 4, wherein electrical power is supplied into the devices or a group of devices adapted for any one of heating, pumping, compression and fractionation, or a combination thereof.

6. The process of claim 1, wherein electrical power is supplied from an external, as related to the hydrocarbon processing and/or production facility, source or sources.

7. The process of claim 6, wherein the external source is a source of renewable energy or a combination of different sources of renewable energy.

8. The process of claim 6, wherein said external source of electrical power is any one of: a photovoltaic electricity generating system, a wind-powered electricity generating system, a hydroelectric power system, or a combination thereof.

9. The process of claim 6, wherein said external source of electrical power is a nuclear power plant.

10. The process of claim 6, wherein said external source of electrical power is any one of: a power turbine, a gas turbine, a steam turbine, a spark ignition engine, a gas engine, a compression engine, a diesel engine, a power plant configured to produce electrical energy from fossile raw materials, and any combination thereof.

11. The process of claim 6, wherein said external source of electrical power is a combined cycle power facility and/or a cogeneration facility that produces steam and electricity.

12. The process of claim 1, wherein electrical power is generated in the hydrocarbon processing and/or production facility.

13. The process of claim 1, wherein the heat recovery unit is a heat exchanger, optionally configured as a secondary transfer line exchanger.

14. The process of claim 1, wherein the cracker apparatus is a reactor adapted for thermal and/or thermochemical hydrocarbon degradation reactions, a reactor adapted for pyrolysis reactions, or a reactor adapted for pyrolysis reactions assisted by the dilution medium.

15. The process of claim 1, wherein the hydrocarbon processing and/or production facility is an olefin plant.

16. The process of claim 1, wherein the hydrocarbon processing and/or production facility is an ethylene plant and/or a propylene plant.

17. The process of claim 1, wherein superheating high pressure steam generated in the TLE unit is at least partly conducted in a preheater furnace.

18. The process of claim 17, wherein heat duty of the preheater furnace is redistributed within the cracker unit of said hydrocarbon processing and/or production facility, through the rearrangement of heat distribution within said cracker unit, such that provision of said preheater furnace in the cracker unit is omitted.

19. The process of claim 1, comprising generation of thermal energy, in a separate combustion chamber, by direct heating implemented by burning hydrogen with oxygen in said combustion chamber and admixing a steam product resulted from hydrogen burning and optionally admixed with the dilution medium with a hydrocarbon feed containing process fluid.

20. The process of claim 19, wherein the temperature of hydrogen burning is regulated by routing the dilution medium into the combustion chamber.

21. The process of claim 1, wherein electrical power supplied from external or internal source(s) compensates for steam production within the hydrocarbon processing and/or production facility fully or partly.

22. The process of claim 1, wherein thermal energy distribution and transfer in the hydrocarbon processing and/or production facility is implemented between a number of cracker units with the same or different layout and/or capacity.

23. The process of claim 2, further comprising conducting shaft power to the at least one cracking apparatus from at least one power turbine arranged in the facility, said at least one power turbine optionally utilizing thermal energy generated in the cracker unit.

24. The process of claim 23, wherein said at least one power turbine is configured as any one of: a steam turbine, a gas turbine and a gas expander, and wherein said power turbine is coupled to the drive engine of the cracking apparatus via a drive shaft coupling.

25. The process of claim 1, wherein the hydrocarbon containing feed is a fraction or fractions of crude oil production, distillation and/or refining.

26. The process of claim 1, wherein the hydrocarbon containing feed is selected from a group consisting of: a gasified preprocessed biomass material; a preprocessed glyceride-containing material; vegetable oils and/or animal fats; a preprocessed plastic waste; by-products of wood pulp industry; and tall oil or any derivatives thereof.

27. The process of claim 1, wherein the functions conducted in said HRU further comprise one or more of (i) heating and/or vaporizing the hydrocarbon containing feed and/or the dilution medium, and (ii) heating and/or vaporizing boiler feed water.

* * * * *